US010864648B2

(12) United States Patent
Whitney

(10) Patent No.: US 10,864,648 B2
(45) Date of Patent: Dec. 15, 2020

(54) HAND OPERATED FOOD CUTTING APPARATUS HAVING A SELF-STABILIZING PUSHER-ARM MECHANISM AND A FOOD-STABILIZING PUSHER-ARM MECHANISM FOR A FOOD CUTTING APPARATUS

(71) Applicant: Edlund Company, LLC, Burlington, VT (US)

(72) Inventor: Ryan S. Whitney, Essex Junction, VT (US)

(73) Assignee: Edlund Company, LLC, Burlington, VT (US)

( * ) Notice: Subject to any disclaimer, the term of this patent is extended or adjusted under 35 U.S.C. 154(b) by 121 days.

(21) Appl. No.: 15/878,011

(22) Filed: Jan. 23, 2018

(65) Prior Publication Data

US 2018/0169880 A1 Jun. 21, 2018

Related U.S. Application Data

(62) Division of application No. 14/618,487, filed on Feb. 10, 2015, now abandoned.

(Continued)

(51) Int. Cl.
*B26D 1/00* (2006.01)
*B26D 1/03* (2006.01)

(Continued)

(52) U.S. Cl.
CPC ..... *B26D 1/0006* (2013.01); *B26D 1/03* (2013.01); *B26D 1/06* (2013.01); *B26D 3/20* (2013.01);

(Continued)

(58) Field of Classification Search
CPC ..... B23D 2001/0066; B23D 1/03; B23D 1/0006; B23D 7/0006; B23D 3/20;

(Continued)

(56) References Cited

U.S. PATENT DOCUMENTS 129,289 A * 7/1872 Meschutt ..... A23N 4/14 99/545
484,155 A 10/1892 Jones (Continued)

FOREIGN PATENT DOCUMENTS

GB 2312613 A 5/1997

OTHER PUBLICATIONS http://www.webstaurantstore.com/edlund-pi368-3-16-3-8-pusher-insert-for-a1525-pusher/333PI368.html; Edlund PI368 3/16" / 3/8" Pusher; Insert for A1525 Pusher; available since at least 2009.

*Primary Examiner* — Jason Daniel Prone
*Assistant Examiner* — Samuel A Davies
(74) *Attorney, Agent, or Firm* — Downs Rachlin Martin PLLC

(57) ABSTRACT

A thrust-type food cutting apparatus that includes a blade set, food product pusher, and a manually operated pusher arm having a self-stable resting-open position in which the food product pusher is spaced from the blade set to allow a user to load the cutting apparatus with food product to be cut. In an embodiment, the cutting apparatus includes a chassis and a pivoting link linking the pusher arm to the chassis to provide the pivot arm with a movable fulcrum pivot that enables the self-stable resting-open pusher arm position. A thrust-type food product cutting apparatus of the present disclosure may include a blade set, a food product pusher, and a retractable food product stabilizer that stabilizes food product loaded into the cutting apparatus and retracts as the food product pusher moves toward the blade (Continued)

set. Such a retractable food product stabilizer may be integrated with a self-stabilizing pusher arm mechanism.

19 Claims, 18 Drawing Sheets

Related U.S. Application Data

(60) Provisional application No. 61/937,903, filed on Feb. 10, 2014.

(51) Int. Cl.
*B26D 3/26* (2006.01)
*B26D 3/20* (2006.01)
*B26D 7/00* (2006.01)
*B26D 1/06* (2006.01)

(52) U.S. Cl.
CPC ..... *B26D 3/26* (2013.01); *B26D 7/0006* (2013.01); *B26D 2001/0066* (2013.01); *Y10T 83/2213* (2015.04); *Y10T 83/8748* (2015.04); *Y10T 83/8756* (2015.04); *Y10T 83/885* (2015.04); *Y10T 83/943* (2015.04); *Y10T 83/9493* (2015.04)

(58) Field of Classification Search
CPC ..... B23D 3/26; Y10T 83/885; Y10T 83/8756; Y10T 83/8748; Y10T 83/943; Y10T 83/9493; Y10T 83/2213; Y10T 83/8841; Y10T 83/8845; Y10T 83/8853; B26D 2001/0066; B26D 1/03; B26D 1/0006; B26D 7/0006; B26D 3/20; B26D 3/26
USPC ..... 221/88.4; D7/673
See application file for complete search history.

(56) References Cited

U.S. PATENT DOCUMENTS 533,164 A 1/1895 Criswell
751,377 A * 2/1904 Carr ..... A23N 4/04 99/537
1,142,627 A * 6/1915 Robinson ..... B21D 28/002 83/590
1,439,501 A 12/1922 Bussinger
2,046,396 A 7/1936 Matter et al.
2,131,092 A 9/1938 Bloomfield
2,302,323 A * 11/1942 Hubbard ..... B26D 3/24 30/114
2,407,924 A 9/1946 Garfunkel
2,470,934 A 5/1949 La Bat
2,497,289 A 2/1950 Bloomfield
2,639,748 A 3/1950 Peel
3,087,366 A * 4/1963 Stults ..... B26D 7/1818 83/145
3,468,355 A * 9/1969 Hall ..... B26D 3/26 99/537
3,750,514 A * 8/1973 Tanaka ..... B26F 1/36 83/454
4,040,343 A 8/1977 DeLucchi
4,081,145 A 3/1978 Moe et al.
4,194,422 A * 3/1980 Williams ..... B23D 21/02 83/581
4,334,469 A 6/1982 Tanner
4,579,028 A 4/1986 Neidhardt
5,058,498 A 10/1991 Chen
D327,822 S * 7/1992 Kong ..... D7/673
5,245,902 A 9/1993 Pereira
5,396,838 A 3/1995 Casapulla
5,478,018 A 12/1995 Wang
5,745,999 A 5/1998 Zirkiev
5,934,166 A * 8/1999 Herlihy ..... B23D 17/08 83/605
6,283,617 B1 9/2001 Stekelenburg
6,451,262 B1 9/2002 Chiodo
7,175,152 B2 2/2007 Dittmer
7,406,914 B1 * 8/2008 Healy ..... A23N 4/20 99/542
8,069,763 B2 12/2011 Stanojevic
8,667,878 B1 3/2014 Lu
2002/0162434 A1 * 11/2002 Acosta ..... B26D 3/10 83/13
2003/0019370 A1 * 1/2003 Corcoran ..... B26D 5/10 100/141
2005/0252387 A1 11/2005 Cornfield
2007/0075214 A1 4/2007 Hong
2008/0160128 A1 7/2008 Cohen et al.
2009/0193952 A1 8/2009 Farid et al.
2010/0313724 A1 12/2010 Farid et al.
2014/0208908 A1 7/2014 Whitney
2014/0208909 A1 7/2014 Whitney
2014/0208910 A1 7/2014 Whitney
2014/0208911 A1 7/2014 Whitney
2014/0208917 A1 7/2014 Whitney
2015/0224658 A1 8/2015 Whitney
2015/0224659 A1 8/2015 Whitney
2015/0224661 A1 8/2015 Whitney
2015/0224662 A1 8/2015 Whitney
2015/0224663 A1 8/2015 Whitney

* cited by examiner

FIG. 14
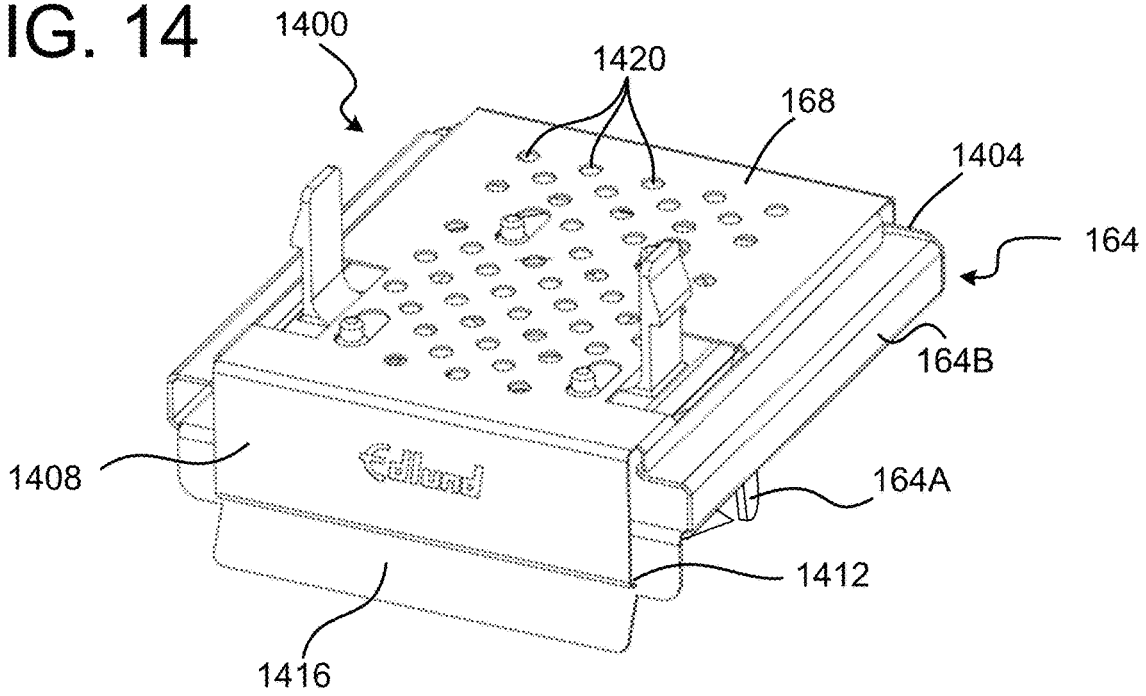
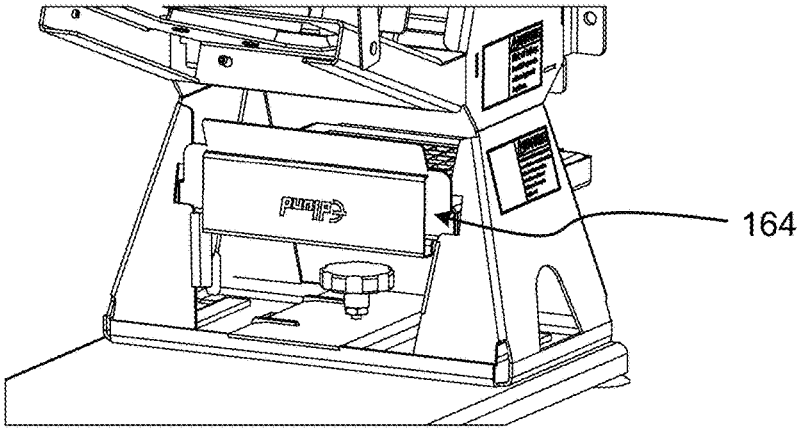
FIG. 15

FIG. 16
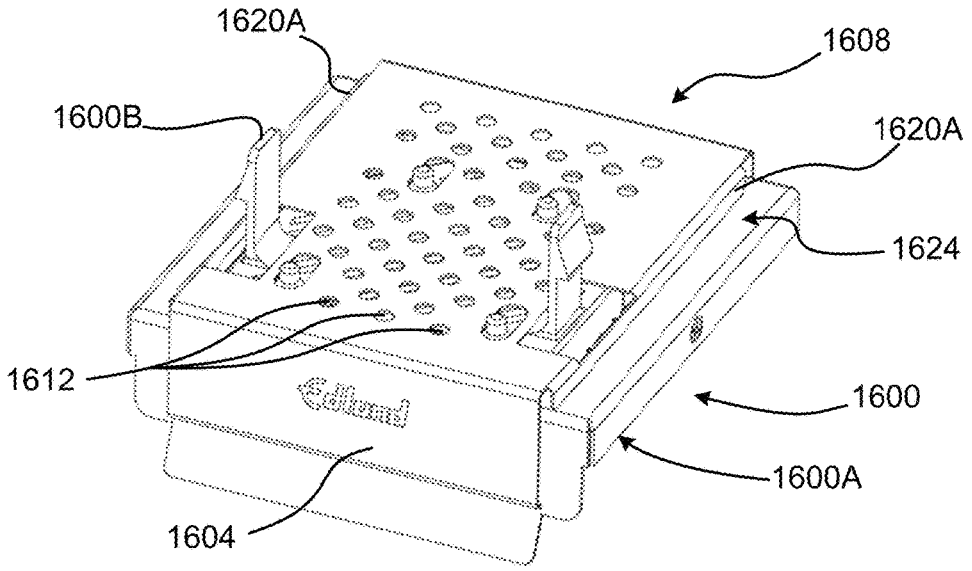
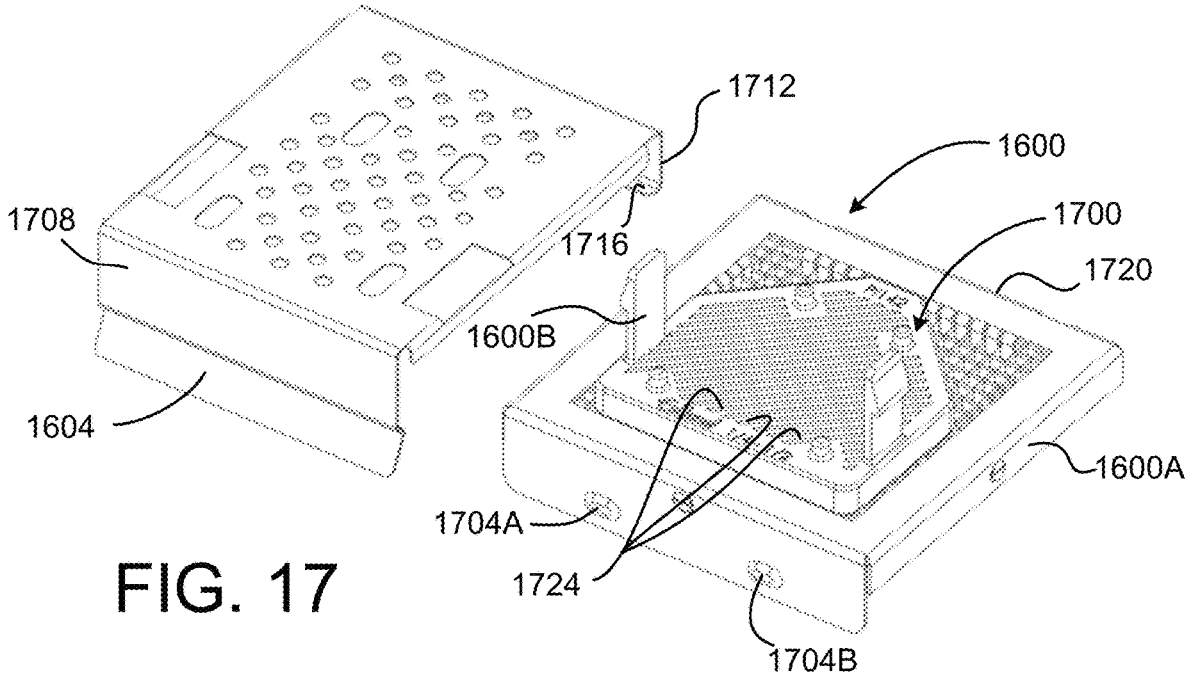
FIG. 17

HAND OPERATED FOOD CUTTING APPARATUS HAVING A SELF-STABILIZING PUSHER-ARM MECHANISM AND A FOOD-STABILIZING PUSHER-ARM MECHANISM FOR A FOOD CUTTING APPARATUS

RELATED APPLICATION DATA

This application is a divisional of U.S. Nonprovisional patent application Ser. No. 14/618,487, filed on Feb. 10, 2015, and titled "Hand Operated Food Cutting Apparatus Having a Self-Stabilizing Pusher-Arm Mechanism and a Food Stabilizing Pusher-Arm Mechanism for a Food Cutting Apparatus", which application claims the benefit of priority of U.S. Provisional Patent Application Ser. No. 61/937,903, filed on Feb. 10, 2014, and titled "FEATURES FOR ENHANCING SAFETY AND OPERABILITY OF THRUST-TYPE FOOD PRODUCT CUTTING APPARATUSES, AND APPARATUSES INCORPORATING SUCH FEATURES," which is incorporated by reference herein in its entirety.

This application is related to the following nonprovisional applications filed herewith:

U.S. patent application Ser. No. 14/618,425, filed on Feb. 10, 2015, and titled "JULIENNING/DICING FOOD PUSHER HAVING EASY-CLEAN CONFIGURATION;"

U.S. patent application Ser. No. 14/618,445, filed on Feb. 10, 2015, and titled "FOOD PRODUCT CUTTING APPARATUS HAVING ONBOARD PUSHER AND BLADE CARTRIDGE STORAGE, AND PUSHER/BLADE CARTRIDGE SETS SUITABLE THEREFOR;"

U.S. patent application Ser. No. 14/618,465, filed on Feb. 10, 2015, and titled "FOOD PRODUCT CUTTING APPARATUS HAVING ANTI-BINDING FOOD PUSHER GUIDE MECHANISM;" and U.S. patent application Ser. No. 14/618,513, filed on Feb. 10, 2015, and titled "FOOD PRODUCT CUTTING APPARATUS HAVING USER-SELECTABLE HORIZONTAL AND VERTICAL MOUNTS THAT PROVIDE THE SAME THRUST AXIS ORIENTATION."

Each of the foregoing related applications is incorporated herein by reference in its entirety.

FIELD OF THE INVENTION

The present invention generally relates to the field of food product cutting apparatuses. In particular, the present invention is directed to a hand operated food cutting apparatus having a self-stabilizing pusher-arm mechanism, and a food stabilizing pusher-arm mechanism for a food cutting apparatus.

BACKGROUND

Preparing food dishes often involves cutting various food products into pieces of desired forms and sizes. Examples of such cutting includes slicing, dicing, Julienning, and wedging. On a small scale, these cutting operations are typically performed using knives. However, on a larger scale, various machines are used to assist with these cutting operations. Such machines range from mandolin slicers, to rotary-type food processors, to manual and powered slicing and other cutting machines. One type of cutting machine used in commercial kitchens for cutting hard food products, such as onions, bell peppers, potatoes, etc., is a thrust-type machine, which can be manually or automatedly actuated. In a typical thrust-type cutting machine, the food product is thrust into a set of blades that cleave the food product into multiple pieces. Depending on the configuration of the blade set, such thrust-type cutting machines can be used for slicing (parallel blades only), wedging (radial blades), Julienning (gridded blades), and dicing (gridded blades (following a pre-slicing operation)).

SUMMARY

In one implementation, the present disclosure is directed to a thrust-type food product cutting apparatus for cutting a food product. The thrust-type food product cutting apparatus includes a chassis designed and configured to engage a supporting structure so that the thrust-type food product cutting apparatus is stable during a cutting operation; a cutting thrust axis forming an angle of 0° to about 30° relative to vertical when the chassis is supported by the supporting structure; a blade set fixed relative to the chassis, the blade set having: a plurality of blades spaced to define a plurality of food openings for receiving therethrough during the cutting operation of the thrust-type food product cutting apparatus; and a cutting edge side; a pusher head movable relative to the blade set toward and away from the blade set on the cutting edge side; a guide mechanism designed and configured to guide the pusher head along the cutting thrust axis during a cutting operation; a handle mechanism coupled to the chassis and engaged with the pusher head, the handle mechanism designed and configured to: provide a self-stable food loading position in which the pusher head is spaced from the blade set; and allow a user to manually drive the pusher head from the self-stable food loading position along the cutting thrust axis toward the blade set with the guide mechanism guiding the pusher head along the cutting thrust axis.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein:

FIG. 14 is an isometric view of the blade-cartridge pusher set combination of FIG. 13 engaged by a retainer/wash cover;

FIG. 15 is a perspective partial view of the food product cutting apparatus of FIG. 1, showing a blade-cartridge/pusher set stowed in the chassis of the food product cutting apparatus of FIG. 1 along with its retainer/wash cover;

FIG. 16 is a perspective view of the blade-cartridge/pusher set of FIG. 15 engaged by its retainer/wash cover;

FIG. 17 is a perspective view of the blade-cartridge/pusher set of FIG. 15 along with its retainer/wash cover, showing the retainer/wash cover removed from the blade-cartridge/pusher set;

DETAILED DESCRIPTION

As will be understood from reading this entire disclosure, aspects of the present invention are directed to, among other things, a hand operated, thrust-type food product cutting apparatus having a handle mechanism that provides its pusher arm with a self-stable food loading position. In some embodiments, the handle mechanism can be augmented with a retractable food product stabilizer that is engaged by a food product when a user places the food product in the cutting apparatus and then retracts as a user applies a food-cutting force to the pusher arm to effect cutting of the food product. Each of these features has one or more benefits. For example, a hand-operated food product cutting apparatus having a self-stable pusher arm made in accordance with the present disclosure avoids the need for providing catches, springs, or other components, etc., that can increase the cost and complexity of manufacture and/or avoids requiring the user to perform additional steps during food cutting operations, such as manually lifting and holding a pusher/pusher assembly with one hand while inserting the food product with the other hand. Regarding the feature of a retractable food product stabilizer, providing such a stabilizer made in accordance with the present invention to a food product cutting apparatus can increase the quality and/or yield of the cut food product, for example, by keeping the food product in the most effective orientation during the cutting operation. Before describing these features and functionalities in detail, however, an exemplary thrust-type food product cutting apparatus, hereinafter, simply "cutting apparatus 100" or "the cutting apparatus," used to illustrate many of these features and functionalities is first described generally to assist the reader with understanding the specific features and functionalities.

Figure 1:
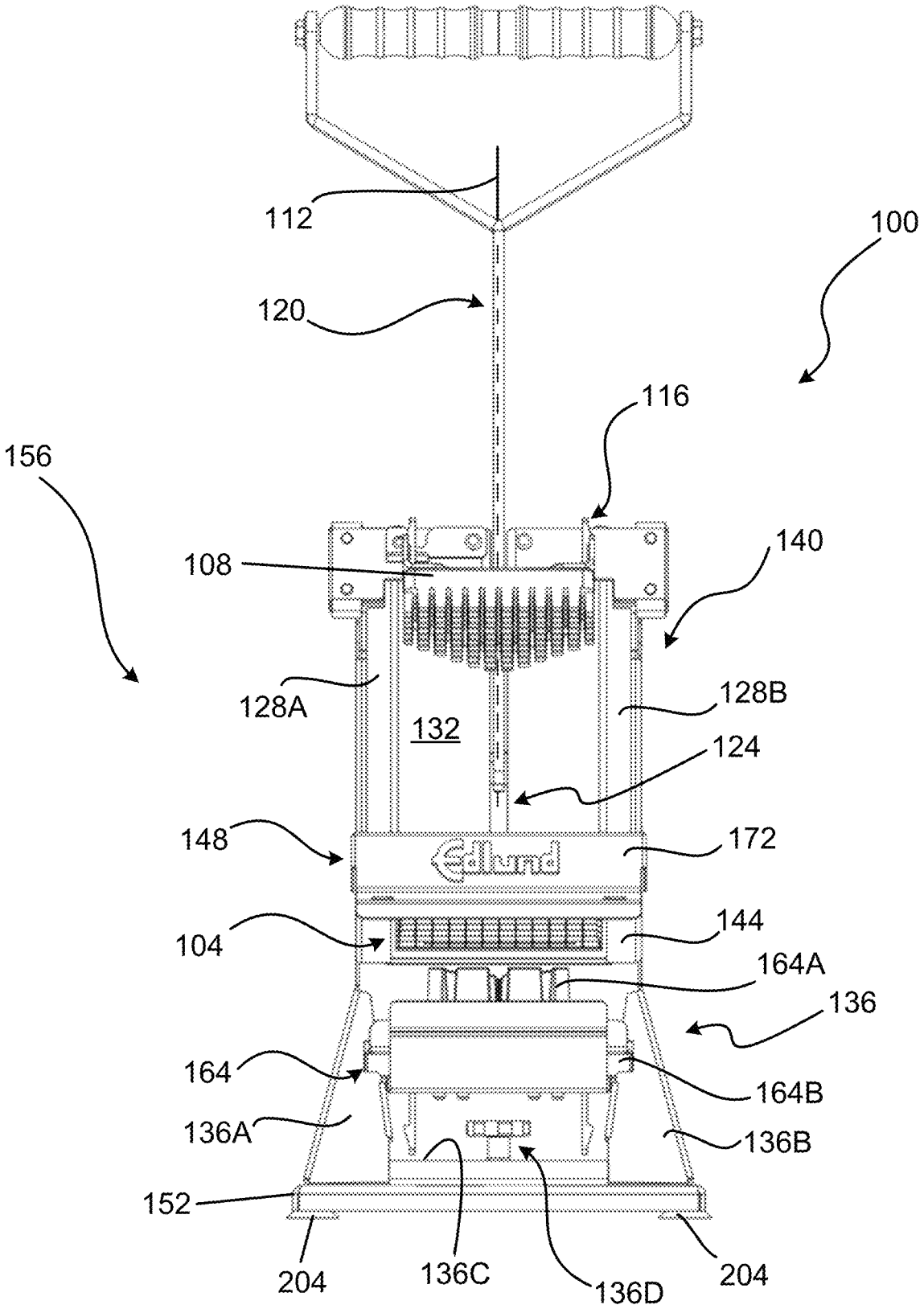
FIG. 1 is a front-elevational view of a manually operated food product cutting apparatus of the present invention mounted on a movable chassis.
Figure 2:
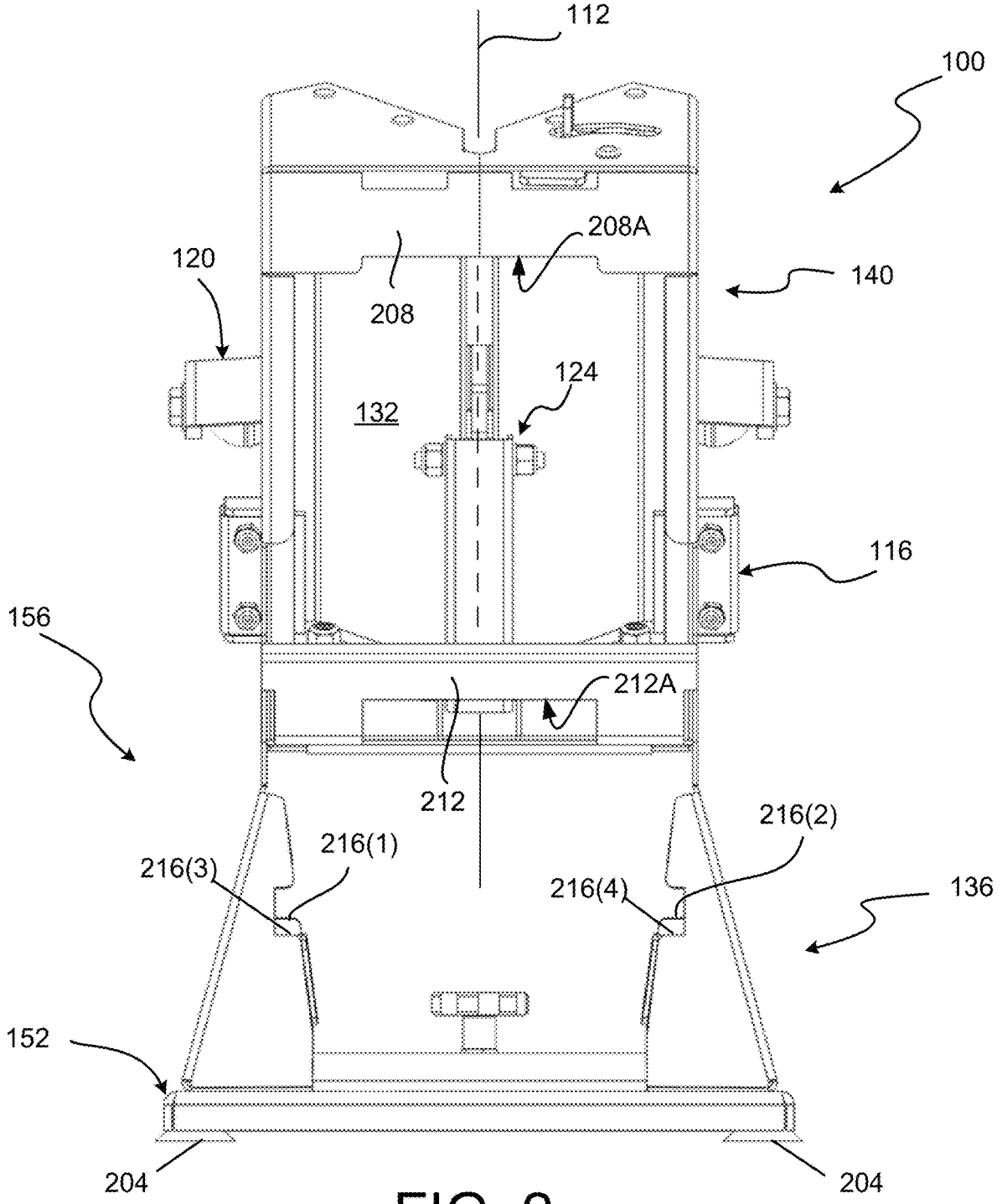
FIG. 2 is a rear-elevational view of the food product cutting apparatus of FIG. 1.
Figure 3:
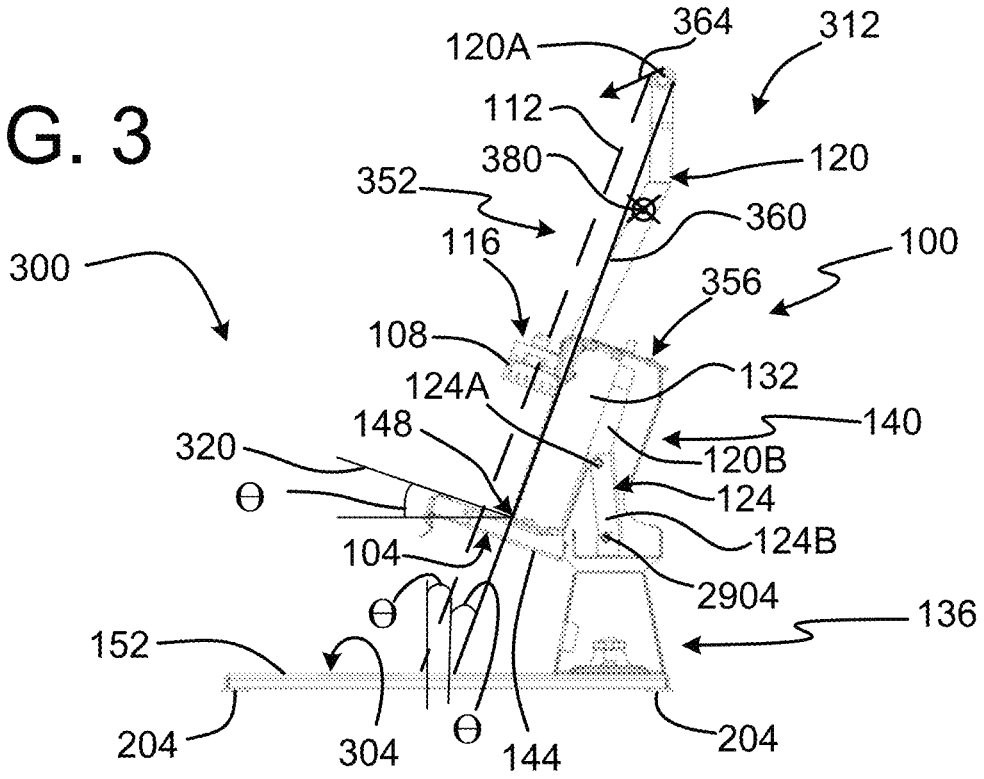
FIG. 3 is a side-elevational view of the food product cutting apparatus of FIG. 1, showing the pusher arm in a resting-open position.

Referring now to FIGS. 1-3, cutting apparatus 100 includes a blade set 104 and a food product pusher 108 movable along a cutting thrust axis 112 to push a food product (not shown, but such as a potato, onion, bell pepper, etc.) through the blade set to cut, for example, cleave, the food product into multiple pieces. As noted in the Background section, above, the nature of the pieces depends upon a number of factors, such as the configuration of blade set (e.g., grid pattern for Julienned pieces or diced pieces, or radial pattern for wedged pieces) and whether or not the food product was cut in a prior operation. Regarding the latter, if the food product was previously cut into slices, then a thrusting of the slices through a gridded blade set will result in diced pieces.

In the embodiment shown, product pusher 108 is moved along cutting thrust axis 112 via a pusher assembly 116 that is moved using a manually operated pusher arm 120 coupled to a linkage mechanism 124. Pusher assembly 116 is slidable along a pair of slide rails 128A and 128B, which in this example are non-cylindrical members that inhibit binding often found in conventional thrust-type cutting apparatuses having cylindrical rods for guides. In the present embodiment, slide rails 128A and 128B are monolithically integrated with lateral sides of a generally V-shaped product guide 132 that, as described below in detail, assists in holding a food product in proper position and orientation during cutting operations. Pusher arm 120 includes a handle 120A that is easily graspable by a user and is located and oriented for easy operation of cutting apparatus 100.

Cutting apparatus 100 comprises a chassis 136 having an upper body 140, which provides support for the upper ends of slide rails 128A and 128B, and, in this example, the upper end of product guide 132. Blade set 104 in the embodiment shown is in the form of a blade cartridge 144, and, correspondingly, cutting apparatus 100 includes a blade-cartridge receiver 148, which is supported by chassis 136 in a manner that it is both cantilevered and angled upward. Benefits of this arrangement are described below in detail.

With the general arrangement of exemplary cutting apparatus 100 in mind, following are detailed descriptions of specific features and functionalities, including the features and functionalities noted above and listed below.

Figure 4:
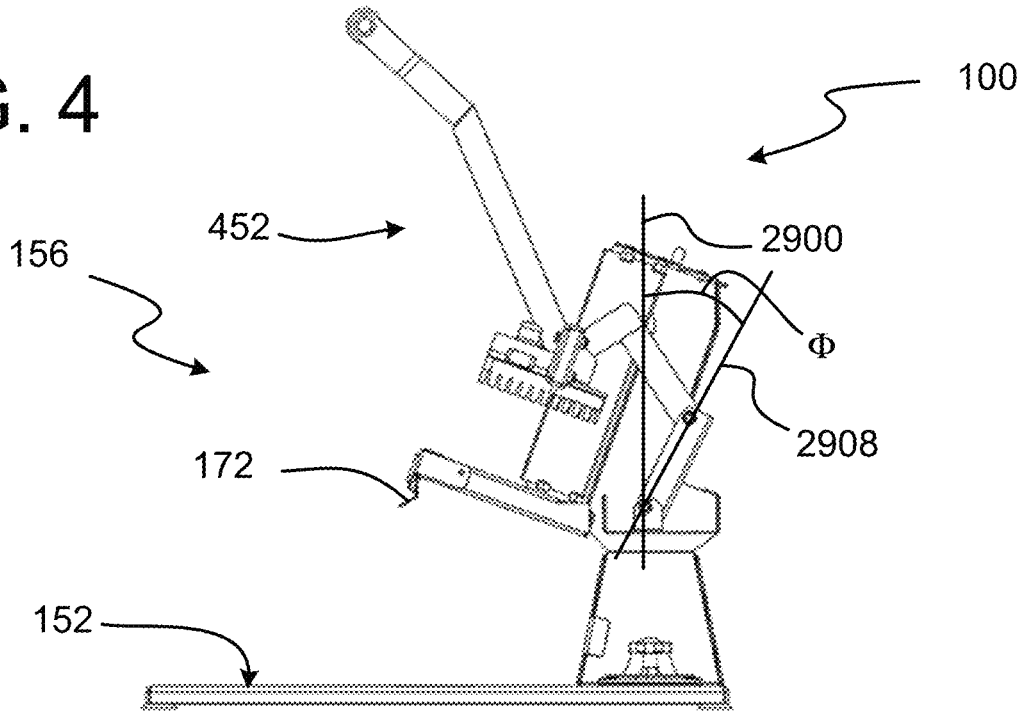
FIG. 4 is a side-elevational view of the food product cutting apparatus of FIG. 1, showing the pusher arm in an intermediate position and showing the side support and a portion of the food product rest removed for clarity.
Figure 5:
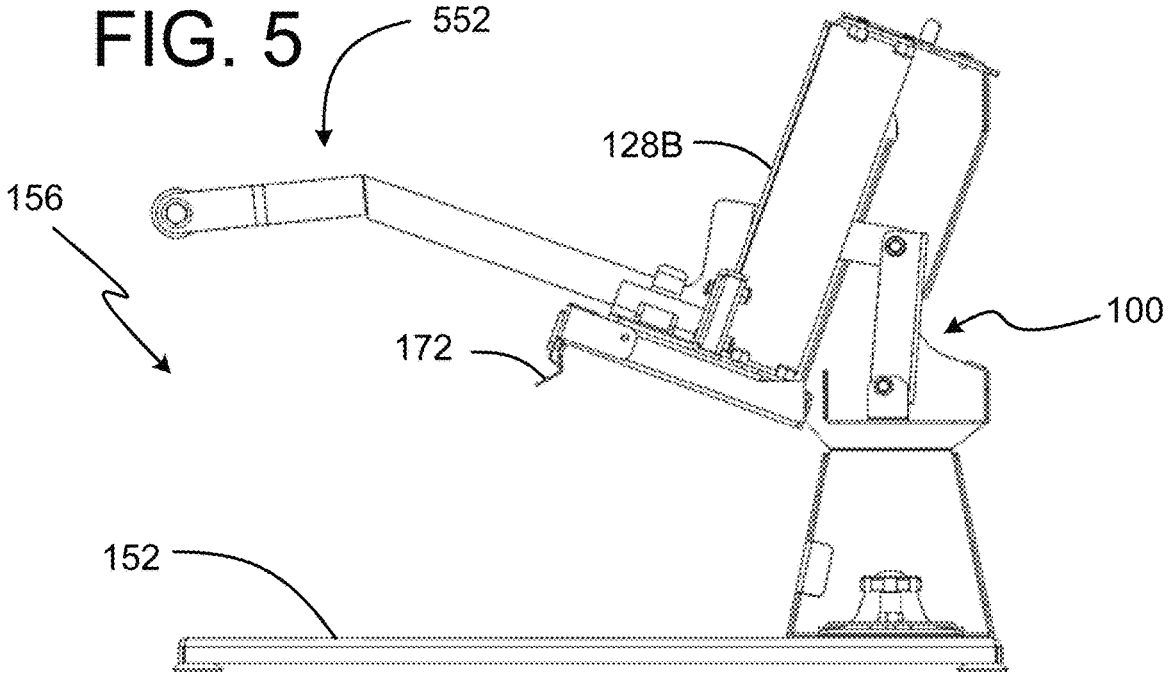
FIG. 5 is a side-elevational view of the food product cutting apparatus of FIG. 1, showing the pusher arm in a fully-closed position with the pusher engaged with the blade set and showing the side support removed.
Figure 6:
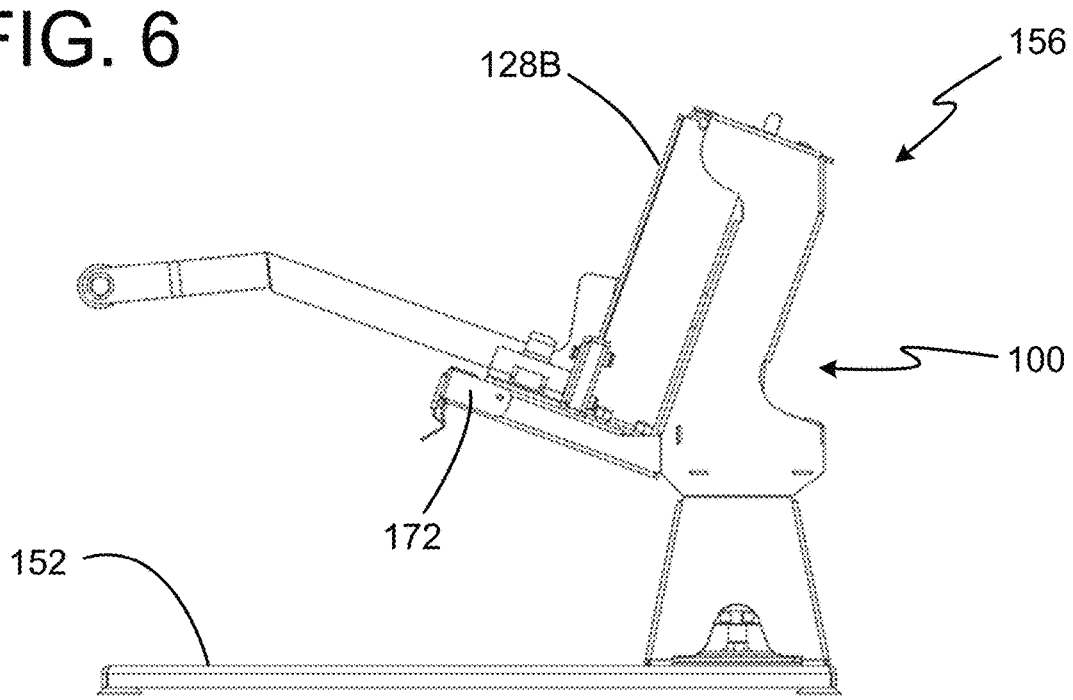
FIG. 6 is a side-elevational view of the food product cutting apparatus of FIG. 1, showing the pusher arm in a fully-closed position with the pusher engaged with the blade set.

Referring now to FIGS. 3-5, these figures illustrate a series of positions of pusher arm 120 prior to and during a cutting operation, ranging from a resting-open position 352 of FIG. 3, to an intermediate position 452 in FIG. 4, and a fully closed position 552 in FIG. 5. Pusher arm 120 and linkage mechanism 124 are integrally designed to provide cutting apparatus 100 with a compact design as well as beneficial features, such as self-stabilized resting-open position 352 of FIG. 3 and the ability to readily integrate a retractable food product stabilizer, such as stabilizer 2204 described below relative to FIGS. 22-25. As those skilled in the art can readily appreciate, the geometry of linkage mechanism 124 in combination with the geometry of pusher arm 120, including the offset extension 120B cooperate to allow the overall size of cutting apparatus 100 to be smaller in a front-to-back dimension and overall height with the pusher arm in a fully open position relative to a cutting device having a similar general configuration but lacking the two-link linkage mechanism and the special geometries of this mechanism and the pusher arm.

Referring to FIG. 3, the particular configuration of pusher arm 120 and linkage mechanism 124, collectively referred to herein and in the appended claims as "handle mechanism" and labeled in FIG. 3 as "356", makes resting-open position 352 stable. As noted above, this self stability has the benefit that one or more springs or other biasing means or locking mechanism or lifting and holding by a user are not needed to hold pusher assembly 116 in spaced relation from blade set 104 to make/keep cutting apparatus 100 ready for receiving a food product for a slicing operation. In the embodiment shown, link 124B has a U-shaped transverse cross-section with the U-shape generally opening toward front 300 of cutting apparatus 100 (see, e.g., FIG. 8), and the end of lever-arm extension 120B at fulcrum pivot 124A is located between the two legs of the U-shape. It is noted that "fulcrum" is used in referring to pivot 124A because pivot 124A is the fulcrum for pusher arm 120 during cutting operations when a user is applying various forces to handle 120A. As those skilled in the art will readily understand and as described in more detail below relative to FIG. 29, when pusher arm 120 is in the leaning-back position shown in FIG. 3, lever-arm extension 120B rests on the base of the U-shape of link 124B at the end of link 124B proximate to fulcrum pivot 124A. In essence, the base of the U-shape of link 124B provides a rotation stop for lever-arm extension 120B. When the center of gravity 380 (FIG. 3) of pusher arm 120 is positioned behind a vertical plane 360 extending through the center of rotation of fulcrum pivot 124A, i.e., to the right of vertical plane 360 in FIG. 3, the pusher arm tends to pivot in a clockwise direction (relative to FIG. 3) about fulcrum pivot, thereby keeping lever-arm extension 120B in contact with the base of the U-shape of link 124B, thereby making resting-open position 352 stable. Those skilled in the art will appreciate that other configurations of lever-arm extension 120B and/or link 124B can be used to provide a suitable travel stop that provides pusher arm 120 with stable resting-open position 352.

As can be readily seen in FIGS. 3-5 and the example shown there, slide rails 128A and 128B are parallel to cutting thrust axis 112. The sliding engagement of slides 2004A and 2004B (FIG. 20) on pusher assembly 116 with slide rails 128A and 128B keeps pusher head 1900 (FIG. 19) of the pusher assembly in a fixed orientation relative to blade set 104, here an orientation in which the pushing face of the pusher head is perpendicular to the cutting thrust axis. Specifically, FIG. 3 shows that pusher assembly 116 is in such fixed orientation when handle mechanism 356 is in stable resting-open position 352, FIG. 4 shows that the pusher assembly remains in such fixed orientation as it is moving toward blade set 104, and FIG. 5 shows that the pusher assembly also remains in such fixed orientation when the pusher head 1900 (FIG. 9) is engaged with the blade set. As is apparent, since slides 2004A and 2004B (FIG. 20) on pusher assembly 116 remain slidingly engaged with slide rails 128A and 128B as a user moves the pusher assembly 116 away from blade set 104 and, correspondingly moves handle mechanism 356 back to stable resting-open position 352, the pusher assembly maintains that fixed orientation relative to the blade set as it is moved back to the stable resting-open position.

Figure 29:
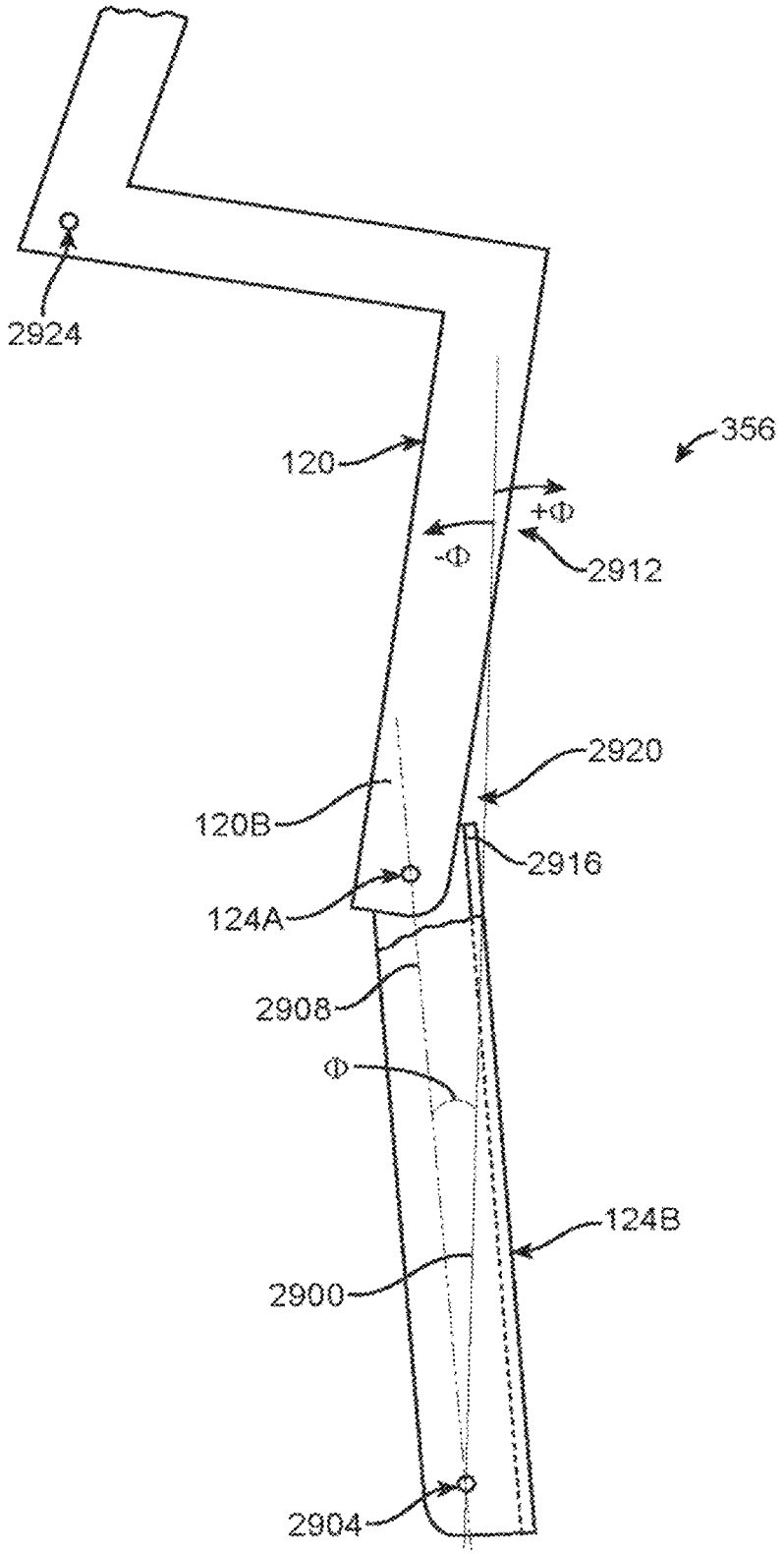
FIG. 29 is an enlarged partial elevational view/partial cutaway view illustrating geometrical considerations of the self-stable handle mechanism of the food product cutting apparatus of FIG. 1.

FIG. 29 illustrates geometric and relational aspects of exemplary handle mechanism 356 and its components that allow pusher arm 120 to have a self-stable resting-open position 352 (FIG. 3). Referring to FIG. 29, and also to FIG. 3, FIG. 29 illustrates a vertical line or plane, or referred to simply herein and in the appended claims as "vertical" 2900, that extends through the center of rotation of a chassis pivot 2904, where link 124B is pivotably connected to chassis 136 (FIG. 3), and is a reference for a pivot angle Φ formed between an axis 2908 of link 124B that connects the center of rotation of fulcrum pivot 124A and the center of rotation of the chassis pivot 2904. As illustrated at region 2912 of FIG. 29 for the sake of understanding the self-stabilizing functionality of handle mechanism 356, negative values of pivot angle Φ are achieved when axis 2908 of link 124A has pivoted to the left of vertical 2900 (shown in FIG. 29) and positive values of pivot angle Φ are achieved when axis 2900 of link 124A has pivoted to the right of vertical 2900 (not shown in FIG. 29, but can be seen, for example, in FIG. 4). With axis 2908 pivoted to a negative value of pivot angle Φ that causes the center of rotation of fulcrum pivot 124A to be in front of center of gravity 380 (FIG. 3) of pusher arm 120 (i.e., to the left of the center of gravity in FIG. 3) and as noted above, self-stable position 352 of pusher arm 120 is achieved by lever-arm extension 120B resting on base 2916 of the U-shape of link 124B at location 2920. When pusher arm 120 is in self-stable position, pusher-head pivot 2924, where the pusher head of pusher assembly 116 (FIG. 3) is attached to the pusher arm, is at its maximum distance from cutting plane 320 (FIG. 3). This is generally due to the geometries of exemplary pusher arm 120 and handle mechanism 356 overall; in other embodiments, the corresponding pusher-head pivot need not necessarily be at its maximum distance from the cutting plane.

As those skilled in the art will readily appreciate, once a user applies an appropriate force to handle 120A (FIG. 3) to initiate a cutting operation, such as force 364 (referred to herein and in the appended claims as a "food-cutting force") when pusher arm 120 is initially in self-stable position 252, axis 2908 starts to pivot clockwise about chassis pivot 2904, with pivot angle Φ becoming less negative and then positive (see, e.g., FIG. 3) as the user continued to apply the food-cutting force to the handle. As those skilled in the art will also appreciate, when a user applies a force generally in the opposite direction of food-cutting force 364 (FIG. 3) so as to move pusher assembly 116 away from cutting plane 320, once the user applies such force long enough that axis 2908 achieves the negative value of angle Φ illustrated in FIG. 29 and lever-arm extension 120B comes to rest on base 2916, the user may let go of handle 120A (FIG. 3) and pusher arm will remain in self-stable position 352.

Figure 23:
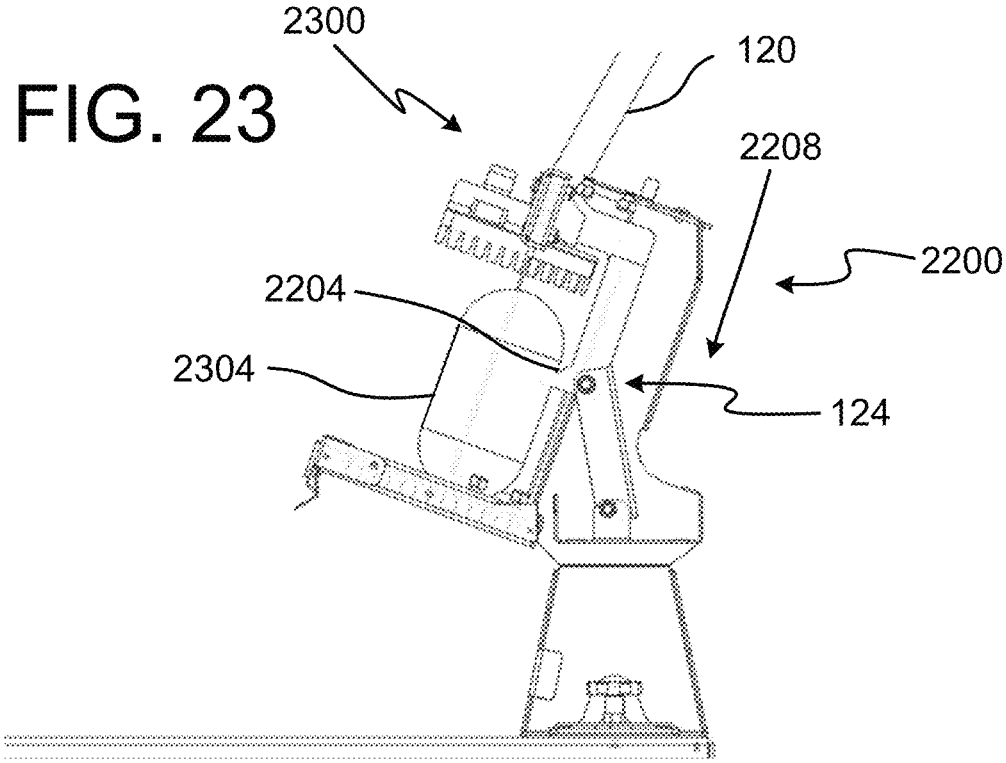
FIG. 23 is a side-elevational partial view of the cutting apparatus of FIG. 22, showing a food product engaged with the retractable food product stabilizer and the pusher arm in a resting-open position and also showing the product guide removed for clarity.
Figure 24:
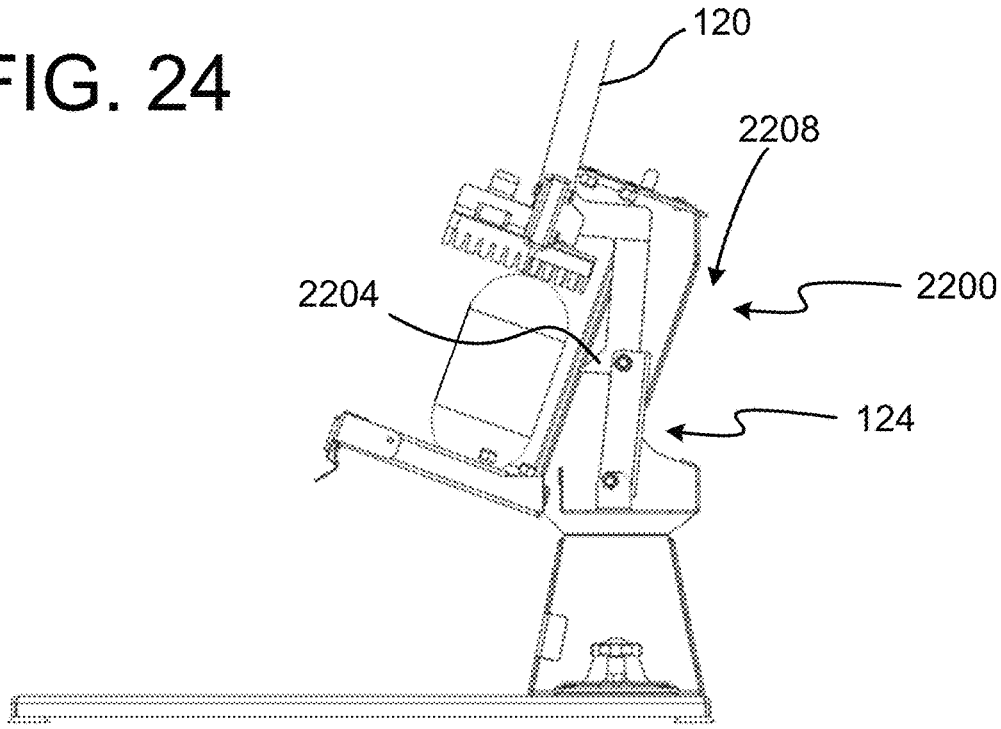
FIG. 24 is a side-elevational partial view of the cutting apparatus and food product of FIG. 23, showing the pusher arm in an intermediate position with the pusher initially engaging the food product and also showing the product guide removed for clarity.
Figure 25:
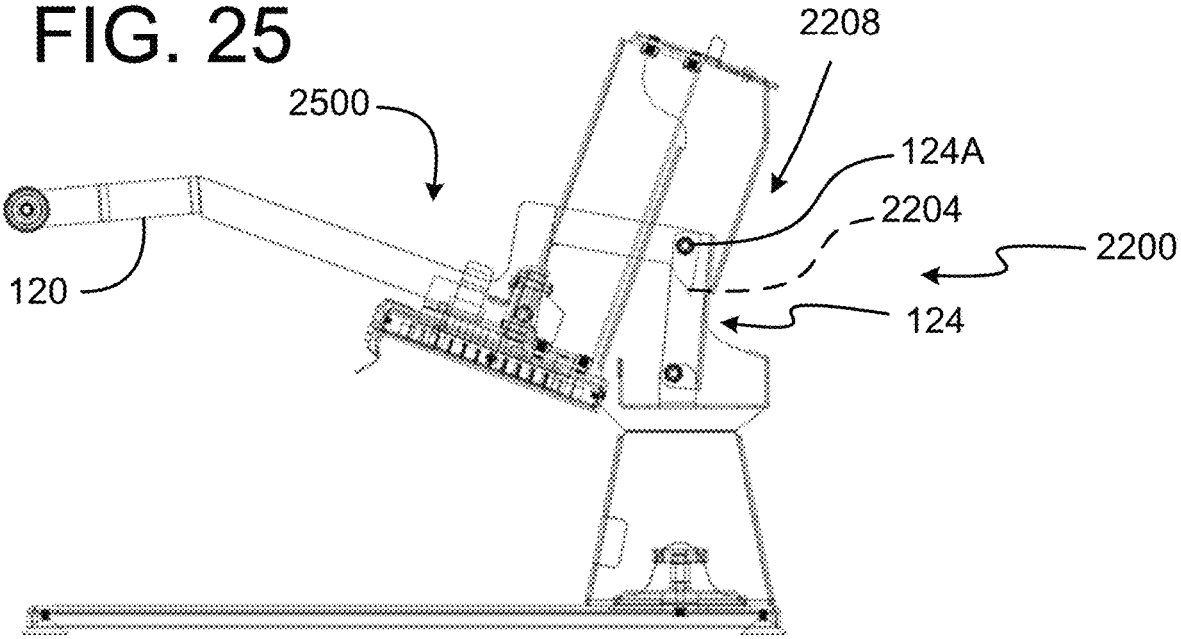
FIG. 25 is a side-elevational partial view of the cutting apparatus of FIGS. 22-24 showing the pusher arm in a fully closed position and also showing the product guide removed for clarity.

Referring now to FIGS. 22-25, these figures illustrate a cutting apparatus 2200 that is identical to cutting apparatus of FIGS. 1-21, except that cutting apparatus 2200 of FIGS. 22-25 includes the enhancement of including a retractable food product stabilizer 2204 added to linkage mechanism 124. As seen in the sequence of FIGS. 23-25 showing differing positions of pusher arm 120, as a user (not shown) moves the pusher arm from resting-open position 2300 (FIG. 23) to fully closed position 2500 (FIG. 25) during a cutting operation, fulcrum pivot 124A of linkage mechanism 124 moves away from a food product 2304 (FIGS. 23 and 24) toward the rear 2208 of cutting apparatus 2200. In the example shown, food product stabilizer 2200 is a piercing member coupled to extension 120B of pusher arm 120 so as to be movable therewith. It is noted that while a single piercing member is shown, other embodiments may include more than one piercing member or one or more other types of stabilizers, such as a rest shaped to conformally receive the food product at issue or a gripper that grips the food product. It is also noted that the retractable food product stabilizer provided may be attached to another part of linkage mechanism 124 or other mechanism that operates in conjunction with the cutting operation. Retraction of food product stabilizer 2200, here the piercing member, during the cutting operation keeps the food product stabilizer from interfering with the cutting operation, but allows for keeping food product 2304 in the optimal position and orientation prior to the user beginning the cutting operation.

In addition to the foregoing aspects, other aspects of the present disclosure are directed to various features and functionalities for food product cutting apparatuses, such as mechanical thrust-type apparatuses that may be configured for slicing, Julienning, wedging, dicing, and any combination thereof. Still other aspects of the present disclosure are directed to food product cutting apparatuses that include one or more of these features and functionalities. Examples of the features and functionalities disclosed herein include, but are not necessarily limited to:

- a food product cutting apparatus that can be mounted on differing types of mounts, such as a fixed horizontal mount, a fixed vertical mount, and a movable horizontal mount;
- a cantilevered blade-set design that allows easy access for collection pans to be moved into and out of position beneath the blade set;
- a backward-leaning design that assists with product stability;
- a chassis configured for storing a blade-cartridge/pusher set;
- a tool-less and fastener-less retainer for securely holding a pusher and corresponding blade cartridge safely together for stowing;
- a snap-fit retainer/wash cover for securely holding a pusher and corresponding blade cartridge safely together for washing;
- a tool-less and fastener-less blade-cartridge lock for securely holding the blade-cartridge in its operational location;
- a quick-connect pusher design that allows the pusher to be readily installed and removed from the food product cutting apparatus;
- an anti-binding guide mechanism for guiding a pusher assembly along its cutting thrust axis;
- a Julienning/dicing pusher having fingers attached to a backing that includes wash openings to enhance washability; and
- a Julienning/dicing blade cartridge having a simplified blade-tensioning arrangement.

For convenience, each of the listed features and functionalities is described below in conjunction with a particular food product cutting apparatus. Although this apparatus is used to illustrate many of these features and functionalities and although apparatus is shown as including many of these features and functionalities, those skilled in the art will readily appreciate that many of these features and functionalities can be implemented in other food product cutting apparatus, such as the apparatus described in U.S. patent application Ser. No. 14/163,858 filed on Jan. 24, 2014, and titled "FOOD PRODUCT SLICERS HAVING A DOUBLE-BEVELED BLADE ARRANGEMENT, AND FEATURES USABLE THEREWITH," U.S. patent application Ser. No. 14/163,897 filed on Jan. 24, 2014, and titled "MULTI-LEVEL BLADE CARTRIDGES FOR FOOD PRODUCT SLICERS AND FOOD PRODUCT SLICERS INCORPORATING MULTILEVEL BLADE CARTRIDGES," U.S. patent application Ser. No. 14/163,918, filed on Jan. 24, 2014, and titled "FOOD PRODUCT SLICERS HAVING FOOD PRODUCT CRADLES," U.S. patent application Ser. No. 14/163,934, filed on Jan. 24, 2014, and titled "FOOD PRODUCT SLICERS HAVING CAMMED SLICING-CLEAVING ACTIONS," and U.S. patent application Ser. No. 14/163,947, filed on Jan. 24, 2014, and titled "PRODUCT PUSHERS FOR FOOD PRODUCT SLICERS AND FOOD PRODUCT SLICERS INCLUDING SUCH PRODUCT PUSHERS," each of which is incorporated herein by reference for its teachings of differing types of food product cutting apparatuses. Those skilled in the art will readily understand how to implement each of the foregoing features in relevant ones of the food product cutting apparatuses. Further, those skilled in the art will readily understand while the food product cutting apparatus illustrated herein contains multiple ones of the foregoing features, other food product cutting apparatuses made in accordance with the present invention may have any one or more of the disclosed features and functionalities and in any logical combination relative to the food product cutting apparatus at issue.

1) Mounting Flexibility

Figure 7:
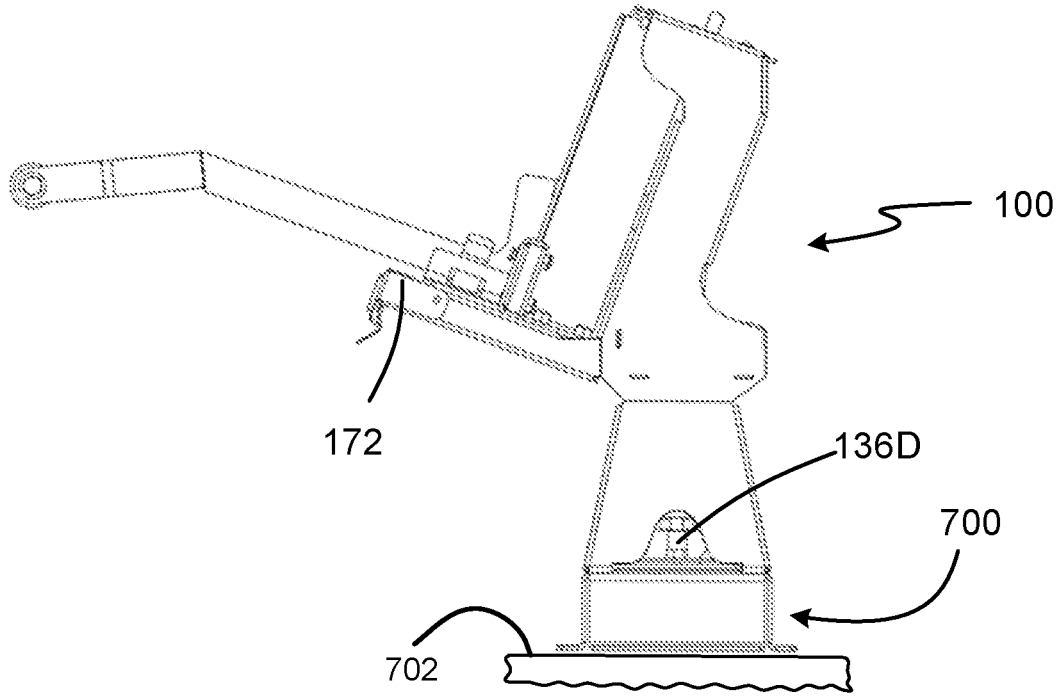
FIG. 7 is a side-elevational view of the food product cutting apparatus of FIG. 1, secured to a horizontal-mounting support.
Figure 8:
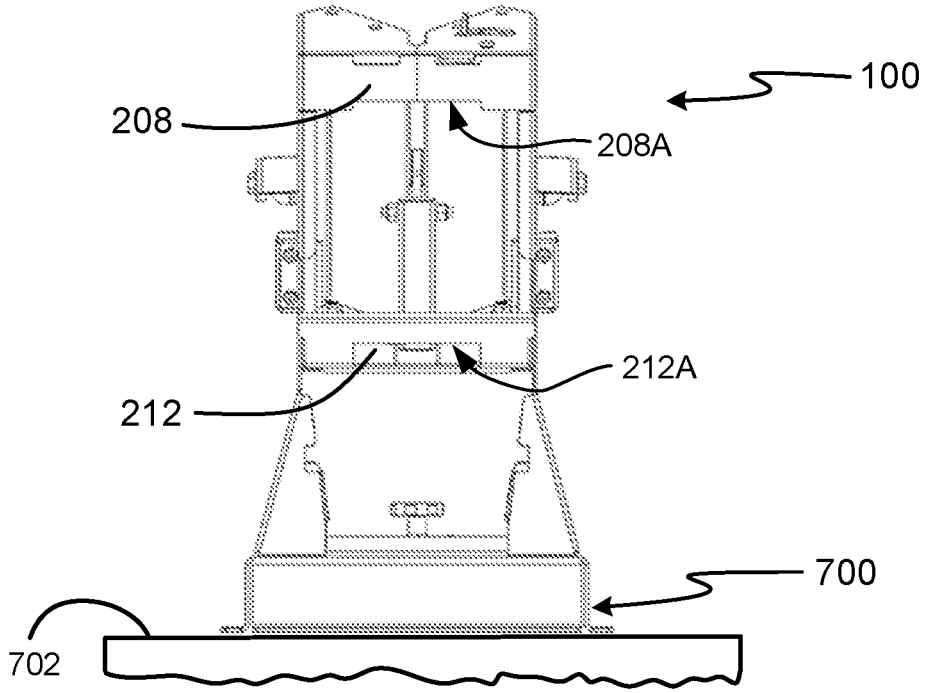
FIG. 8 is a rear-elevational view of the assembly of FIG. 7.
Figure 9:
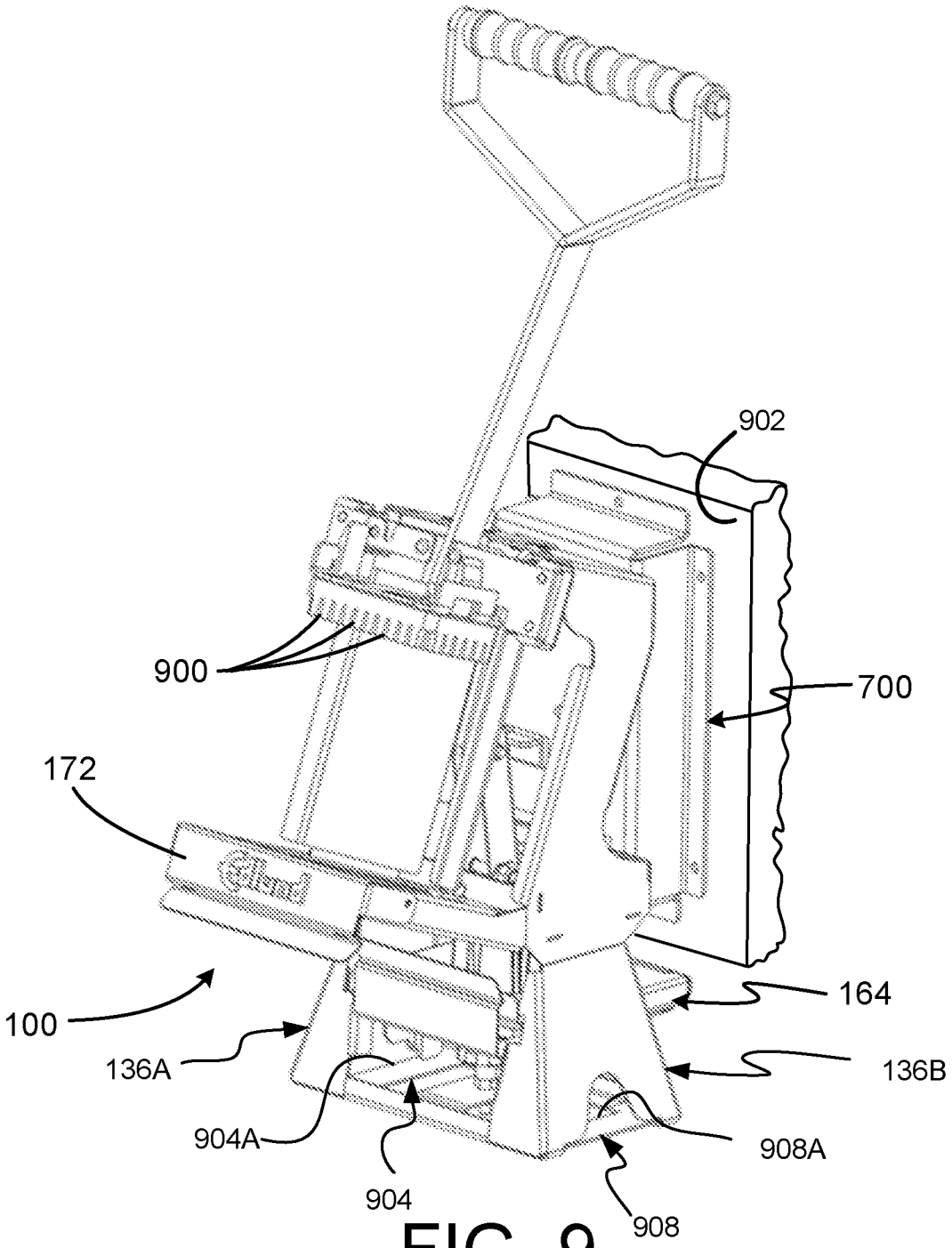
FIG. 9 is an isometric view of the food product cutting apparatus of FIG. 1, secured to a vertical-mounting support.
Figure 10:
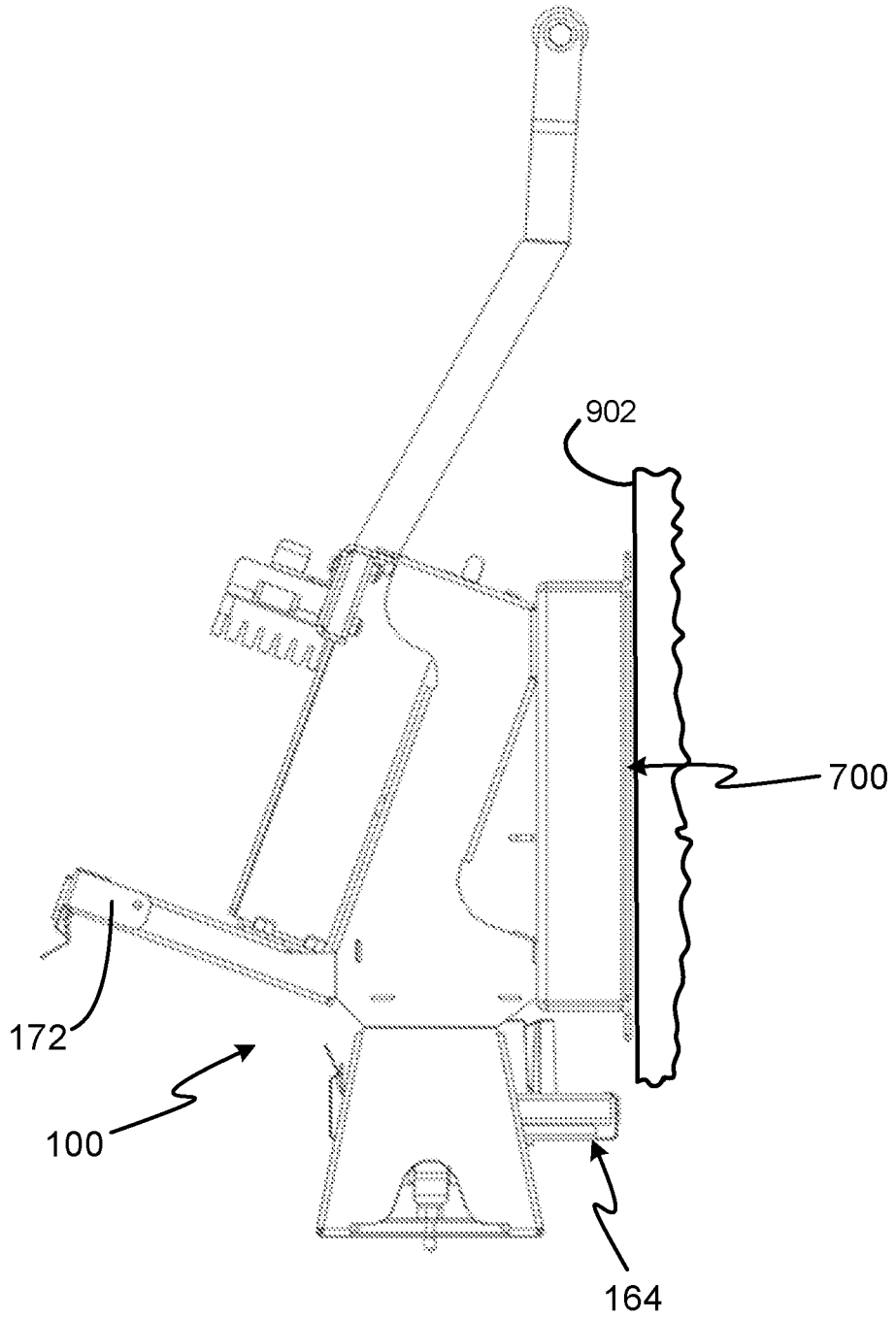
FIG. 10 is a side-elevational view of the assembly of FIG. 9.
Figure 26:
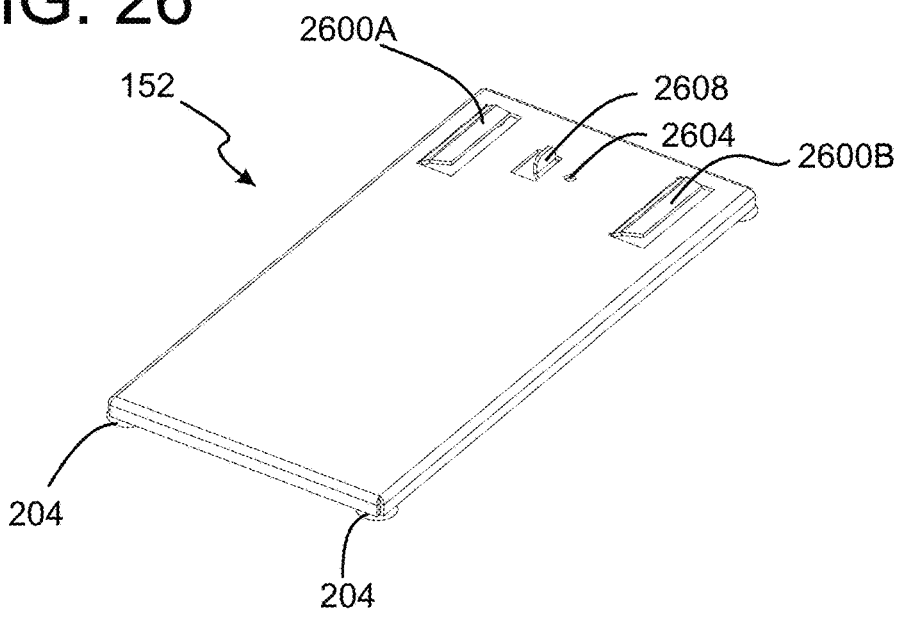
FIG. 26 is an isometric view of the movable horizontal mount of FIGS. 1-6 and 22-25.
Figure 27:
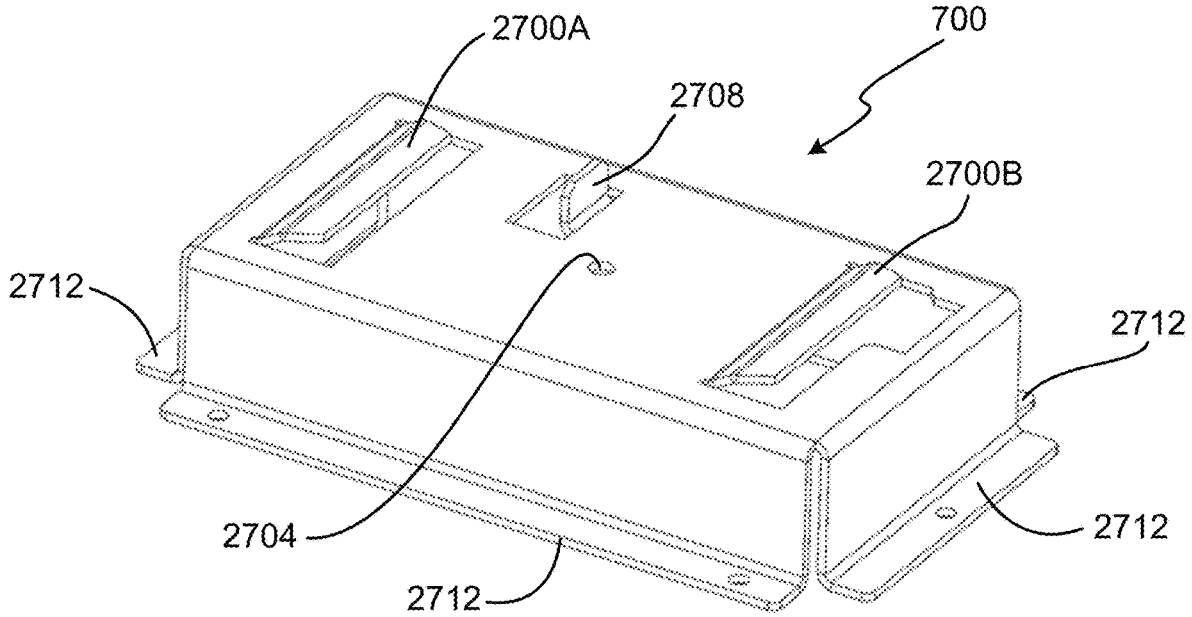
FIG. 27 is an isometric view of the universal fixed mount shown in a horizontal orientation for use in fixed horizontal mount application, such as illustrated in FIGS. 7 and 8.
Figure 28:
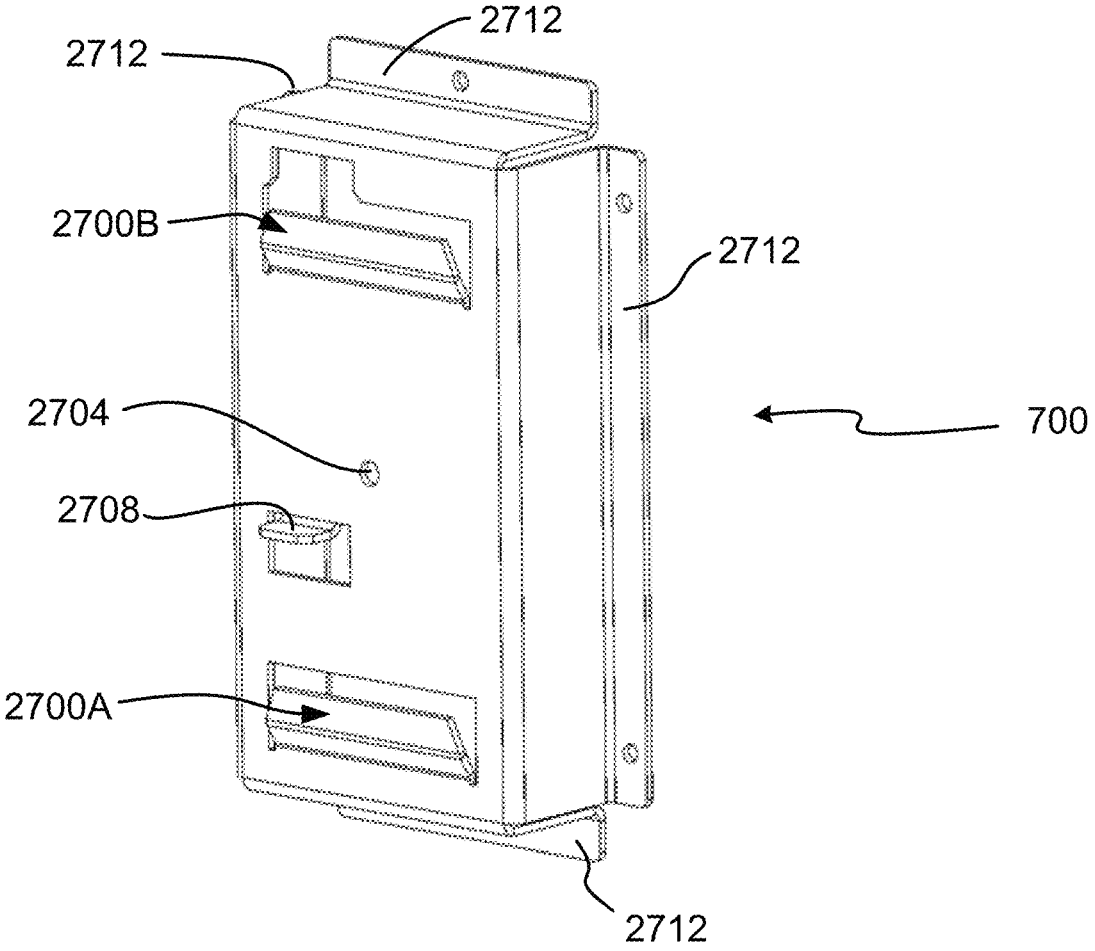
FIG. 28 is an isometric view of the universal fixed mount shown in a vertical orientation for use in fixed vertical mount application, such as illustrated in FIGS. 9 and 10.

Cutting apparatus 100 is specially designed for being mounted in differing manners, here, to a movable horizontal mount 152 (see, e.g., FIGS. 1-6 and 26) and to a universal fixed mount 700 (FIGS. 7-10, 27, and 28), which is shown in a horizontal orientation in FIGS. 7, 8, and 27 and in a vertical orientation in FIGS. 9, 10, and 28. These differing mounting options provide a number of benefits, such as having to make a single apparatus that users can customize simply by selecting the desired mount and/or mount orientation and allowing a user to use a single cutting apparatus in multiple locations. Regarding the former, a manufacture may, for example, sell cutting apparatus 100 separately from differing mounts 152, 700 such that a customer would buy only the mount(s) desired. Regarding the latter, a user may, for example, from time to time want to move cutting apparatus 100 from a countertop location (e.g., using either of movable horizontal mount 152 or universal fixed mount 700 in a horizontal orientation) to a vertical mount location, such as to cut a large number of potato fries and have them drop into a large container that sits on the floor. If the scenario is moving cutting apparatus from a fixed horizontal mount to a fixed vertical mount, the user can have two universal mounts 700, one permanently mounted in a horizontal orientation and the other permanently mounted in a vertical orientation.

Referring first to FIGS. 1-6 and 26, when cutting apparatus 100 is secured to movable horizontal mount 152, a user can move the combined unit 156 freely without undoing any mechanical engagement, allowing the user to move the combined unit, for example, to another location for use, storage, or cleaning there or to facilitate cleaning around and under the location from which it is moved. In the example shown, movable horizontal mount 152 extends beyond the front 300 (FIG. 3) of cutting apparatus 100 to provide stability for the cutting apparatus as a user performs a cutting operation by exerting forward and/or downward force on handle 120A. Also in the example shown, movable horizontal mount 152 provides an expansive flat surface 304 for receiving a container (not shown) that catches pieces of the food product (not shown) after being cut by blade set 104. However, in other embodiments, movable horizontal mount 152 may be configured differently so as to not include expansive flat surface 304. For example, such an alternative movable horizontal mount may be U-shaped with chassis 136 of cutting apparatus 100 being secured to the mount at the base of the U-shape, with the legs of the U-shape extending beyond front 300 of the cutting apparatus. Other configurations are possible.

In the embodiment shown, movable horizontal mount 152 is made of sheet metal and includes a pair of outstanding receivers 2600A and 2600B formed from the sheet metal as shown particularly in FIG. 26. Each receiver 2600A and 2600B slidingly receives a corresponding horizontal-mounting feature 904A, 908A (FIG. 9) of a corresponding respective engagement member 904, 908 that is part of one or the other of the two legs 136A and 136B of chassis 136 of cutting apparatus 100. Chassis 136 includes a cross member 136C that extends between legs 136A and 136B and supports a screw arrangement 136D. A user uses screw arrangement 136D to secure cutting apparatus 100 to movable horizontal mount 152 by threadingly engaging the screw arrangement with a corresponding threaded opening 2604 (FIG. 26) on the movable horizontal mount once the engagement members on the legs are fully engaged with the corresponding respective L-shaped receivers on the movable horizontal mount. Many other ways exist for securing cutting apparatus 100 to movable horizontal mount 152. In this embodiment, movable horizontal mount 152 includes rubber feet 204, here suction cups, to enhance stability of cutting apparatus 100 during cutting operations. Other stability-enhancing features can be used. It is also noted that in the embodiment shown in FIG. 26, movable horizontal mount 152 also includes an alignment stop 2608 that assists a user in aligning cutting apparatus 100 so that screw arrangement 136D is properly aligned with threaded opening 2604 without requiring the user to fiddle with the alignment. Correspondingly, cross member 136C of chassis 136 of cutting apparatus 100 includes a corresponding stop (not shown) that contacts alignment stop 2608 when screw arrangement 136D is properly aligned with threaded opening 2604. In this embodiment, alignment stop 2608 and corresponding stop on chassis 136 are provided for convenience of the user and in lieu of relying on receivers 2600A and 2600B for alignment. In alternative embodiments, other alignment features can be provided.

FIGS. 7 and 8 illustrate that cutting apparatus 100 can be mounted to a fixed horizontal mount, such as universal fixed mount 700 oriented in a horizontal manner (see also FIG. 27), that can be secured to any suitable supporting structure 702, such as a table, counter, or other work station. In this example, vertically mounted universal fixed mount 700 is made of sheet metal and includes lateral flanges 2712 for receiving mechanical fasteners (not shown) for securing the universal fixed mount to the supporting structure 702 at issue. Horizontally mounted universal fixed mount 700 can be configured to receive cutting apparatus 100 in the same manner as movable horizontal mount 152 of FIGS. 1-6, so that the same attachment scheme can be used. For example and as seen in FIG. 7, screw arrangement 136D can be used to secure cutting apparatus 100 to universal fixed mount 700 after engaging engagement members (not shown) on base legs 136A and 136B (FIG. 1) with corresponding respective outstanding receivers 2700A and 2700B (FIG. 27) on the universal fixed mount. As those skilled in the art will readily appreciate, there are a variety of ways that cutting apparatus 100 can be secured to fixed horizontal mount 152 and that the fixed horizontal mount can be secured to a structure, such as the supporting structure 702. Like movable horizontal mount 152 of FIG. 26 and as seen in FIG. 27, universal fixed mount 700 shown also includes a threaded opening 2704 and an alignment stop 2708 having the same functions as described above relative to threaded opening 2604 and alignment stop 2608 of movable horizontal mount 152 described above.

FIGS. 9 and 10 illustrate that cutting apparatus 100 can be engaged with a fixed vertical mount, such as universal fixed mount 700 oriented in a vertical manner (see also FIG. 28), that can be secured to any suitable supporting structure 902, such as a wall or column, among other things. Again, and as seen in FIGS. 27 and 28, universal fixed mount 700 includes receivers 2700B and 2700A, which in the vertical orientation of the universal fixed mount open upwardly to receive corresponding respective upper and lower members 208 and 212 (FIGS. 2 and 8) so as to securely hold cutting apparatus 100 to the mount. As should be evident to those skilled in the art, since the same universal fixed mount 700 is used for both of the horizontal and vertical mounting scenarios illustrated herein, the spacing of upper and lower members 208 and 212 is virtually the same as the spacing of the members (not shown) on the bottoms of base legs 136A and 136B in order to make fixed mount 700 universal to both by way of receivers 2700A and 2700B. In other embodiments, different spacings can be used with either differing mounts or the same mount with different sets of receiver features.

2) Cantilevered Blade Set

In cutting apparatus 100, blade set 104 is cantilevered from chassis 136 as seen in many of the figures, such as FIGS. 3-7, 9, and 10. This cantilevered arrangement solves a problem that many conventional vertically oriented thrust-type cutting apparatuses have, i.e., little or no room to place a catch container of any reasonable standard size. In many conventional cutting apparatuses of this type, their chassis are configured so that it is most practical to simply allow the cut food product to fall onto the supporting countertop at which point the user must transfer the cut food product into a container, such as by pulling it along the countertop to the edge and then into the container. Sometimes a small catch container can be positioned underneath the blade set, but often after having to fiddle with the orientation of the container and/or awkwardly maneuvering it through openings in the chassis. In contrast, with the cantilevered arrangement of blade set 104 of cutting apparatus 100, a user has 180° of unobstructed access to the space beneath the blade set and, thus, is free to place most any size catch container, or portion thereof, in that space.

3) Backward-Leaning Design

In addition to blade set 104 being cantilevered from chassis 136 as just described, overall, cutting apparatus 100 has a backward-leaning design in which cutting thrust axis 112 angles toward rear 312 (FIG. 3) at an angle, θ, as it extends from chassis 136. In this connection, it is noted that the cutting plane 320 of blade set 104 is perpendicular to cutting thrust axis 112, such that the cutting plane tilts upward by the same angle θ as it extends away from chassis 136. In the illustrated embodiment, angle θ is 20°, but in other embodiments it can be any other angle between 0° an 90°, and more typically in a range of about 10° to about 45°. This backward-leaning configuration provides a number of benefits. For example and as those skilled in the art can readily envision, with cutting plane 320 tilting upward, cut pieces (not shown) of the food product are ejected from blade set 104 in a direction somewhat away from chassis 136. This can be beneficial in allowing use of larger catch containers and to require less spreading out of the cut pieces as they accumulate in the catch container. Another benefit of the backward-leaning configuration is better ergonomics for the cutting operation relative to the actuation of pusher arm 120. With the backward-leaning orientation and proper design of pusher arm 120 and linkage mechanism 124, the movements needed from a user to operate the pusher arm are easy to make.

Yet another benefit of the backward-leaning configuration of cutting apparatus 100 is the interplay between the backward lean of cutting thrust axis 112 and upward tilt of cutting plane 320 on the one hand and product guide 132 on the other. In the embodiment shown, product guide 132 leans backward at the same angle θ as cutting thrust axis 112. To use cutting apparatus 100, when pusher arm 120 is in its resting-open position (FIG. 3), a user places a food product, such as a sliced or unsliced potato, onion, etc., onto blade set 104 and preferably in contact with both lateral sides 132A and 132B (see, e.g., FIG. 1) of product guide 132. With the backward lean, and the food product contacting each of lateral sides 132A and 132B and blade set 104, there are at least three points of contact between cutting apparatus 100 and the food product to provide the food product with stability. The backward lean of product guide 132 makes it easier for the user to find an orientation of the food product that is stable. Exemplary cutting apparatus 100 can be modified to include a retractable food product stabilizer, such as retractable food product stabilizer 2204 of FIGS. 22-25, which for many types of food product may be unnecessary because of their inherently stable shapes, such as spherical, that are suited to high stability with three-point support.

4) Blade-Cartridge/Pusher Set Storage

Figure 12:
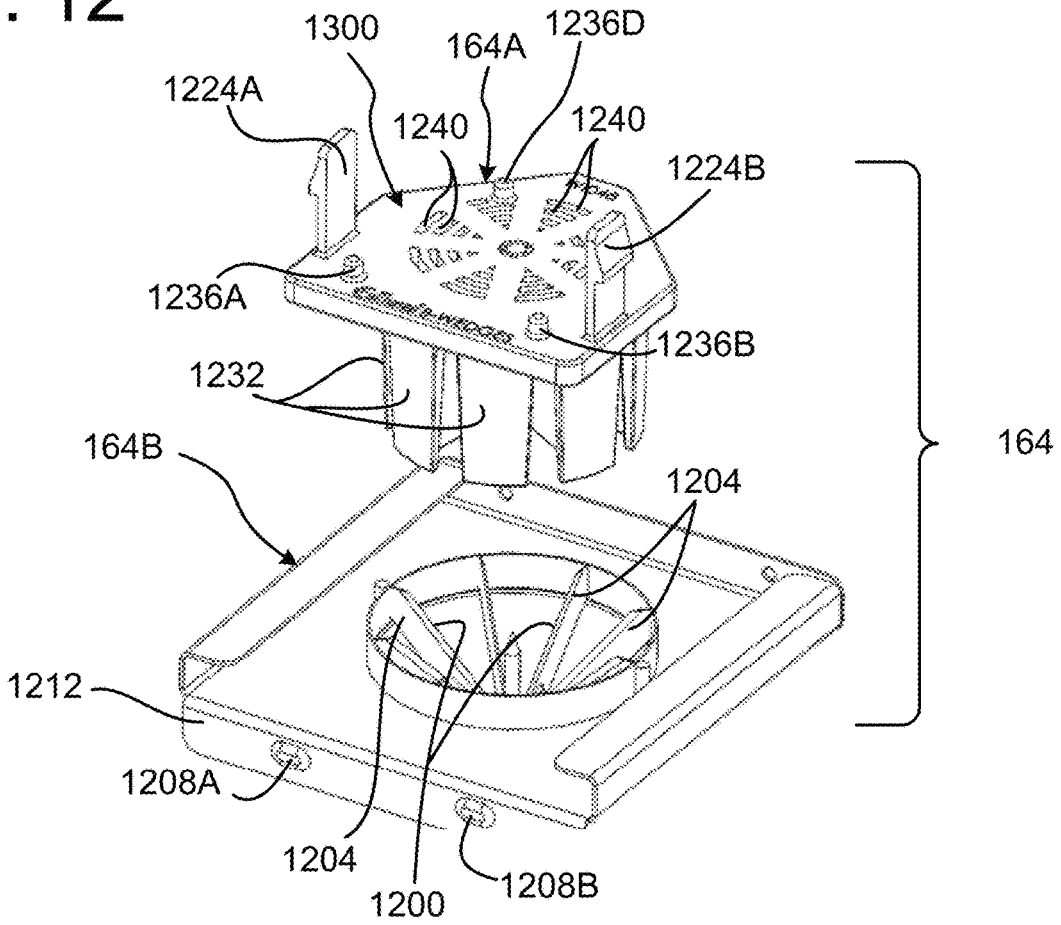
FIG. 12 is an isometric view of a blade-cartridge/pusher set, showing a wedging pusher in spaced relation with a corresponding wedging blade cartridge that can be used in a food product cutting apparatus, such as the food product cutting apparatus of FIG. 1.
Figure 13:
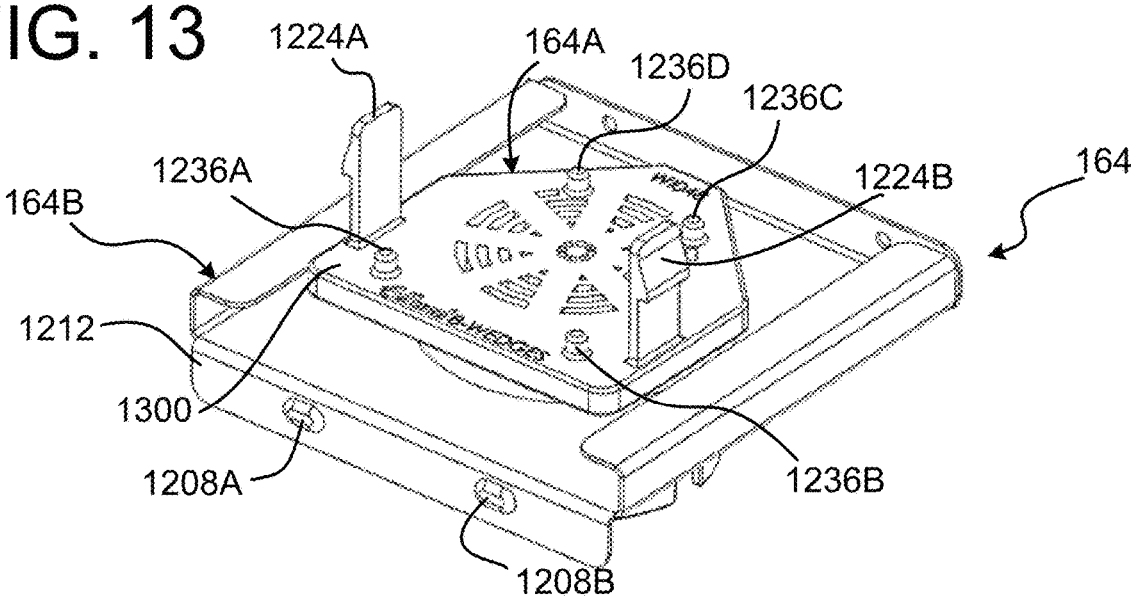
FIG. 13 is an isometric view of the blade-cartridge/pusher set of FIG. 12, showing the pusher fully engaged with the blade cartridge.
Figure 18:
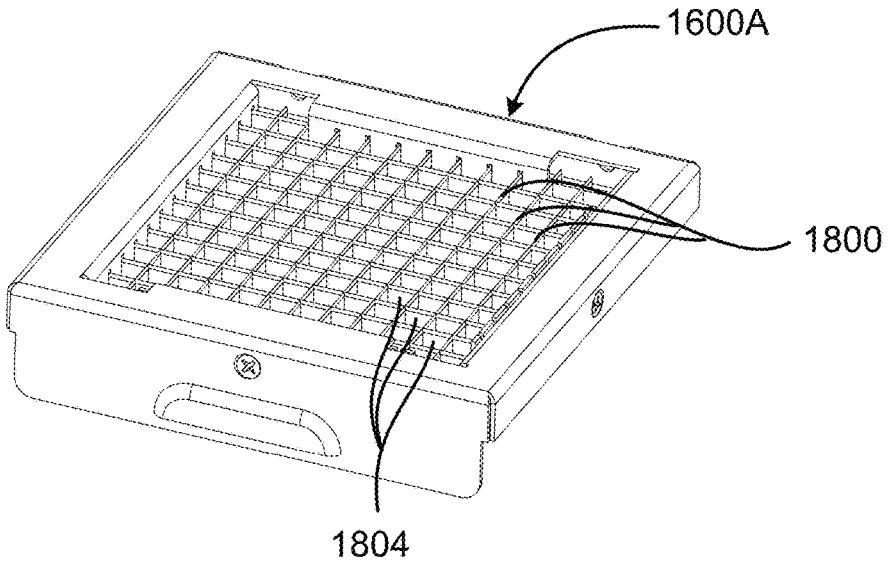
FIG. 18 is a perspective view of the blade cartridge of FIG. 15.

As seen in FIGS. 1, 2, 8-10, and 15, chassis 136 of cutting apparatus 100 is configured to receive a blade-cartridge/pusher set 164 (FIGS. 1, 9, 10, and 15) for storage. As described below in more detail, cutting apparatus 100 is designed to be readily reconfigurable in terms of pushers and matching blade sets. For example, by switching from a gridded pusher and blade set, for dicing and Julienning, to a wedging pusher and blade set, cutting apparatus 100 can be changed from a dicer/Julienner to a wedger. In this example, the blade-cartridge/pusher set storage capability can be handy for storing the blade-cartridge set not currently being used. In the embodiment shown, this storage capability is enabled by providing base legs 136A and 136B with suitable located receptacles 216(1) to 216(4) (FIG. 2) that slidingly receive blade-cartridge/pusher set 164. As best seen in FIGS. 1 and 10, in this example blade-cartridge/pusher set 164 includes a wedging pusher 164A (FIG. 1) and corresponding wedging blade cartridge 164B. FIGS. 12 and 13 illustrates wedging pusher 164A and blade cartridge 164B in greater detail and in an inverted orientation relative to FIGS. 1 and 10. In addition, FIG. 14 shows wedging pusher 164A and blade cartridge 164B engaged by a retainer 168 that holds the pusher in firm engagement with the blade cartridge, as described below in more detail. Wedging blade-cartridge/pusher set 164 can be swapped out for another type of set, such as the Julienning/dicing set 1600 shown in FIGS. 16 and 17. As seen in FIGS. 16 and 17, Julienning/dicing blade-cartridge/pusher set 1600 includes a gridded blade cartridge 1600A and a corresponding pusher 1600B, which in the example, are held together by a suitable retainer 1604. Other types of storage arrangements can be used.

5) Pusher/Blade-Cartridge Storage Retainer with Optional Wash Features

Referring again to FIGS. 12-14, as noted above FIG. 14 illustrates wedging blade-cartridge/pusher set 164 in which pusher 164A is held firmly in engagement with blade cartridge 164B by retainer 168, which functions to create a unitary assembly 1400 that is safe for handling and convenient for storage, such as in the manner described above in section 5. To create assembly, a user (not shown) engages pusher 164A, which as described below is readily removable from pusher assembly 116 (FIG. 1) of cutting apparatus 100, with corresponding blade-cartridge 164B as shown in FIG. 13 from the side of the blade cartridge having the sharp edges 1200 (FIG. 12) of the blades 1204. In this manner, when pusher 164A is fully inserted into blade cartridge 164B as shown in FIG. 13, the backing 1300 (FIG. 13) of the pusher covers sharp blade edges 1200 (FIG. 12), thereby blocking a user from contacting the sharp edges and preventing injury. Once the user has fully engaged pusher 164A with blade cartridge 164B, the user can install retainer 168 as shown in FIG. 14 to hold the pusher and blade cartridge together for convenient handling, storage, etc. As seen in FIG. 14, in the embodiment shown, retainer 168 is designed and configured to hook around the backside 1404 of blade cartridge 164B and provide a snap-fit engagement with a pair of spaced bosses 1208A and 1208B (FIG. 12) formed on the "front" 1212 of the blade cartridge. As those skilled in the art will understand, the "front" portion 1408 (FIG. 14) of retainer 168 is designed and configured to include a catch 1412 that catches on bosses 1208A and 1208B (FIG. 12) as the front portion springs back after leading end 1416 slides over the bosses during engagement of retainer 168 with blade-cartridge/pusher set 164. Other types of securing means, such as one or more slots and corresponding tab-type catches, a sliding-engagement arrangement, and/or one or more mechanical fasteners, among others, can be used to secure retainer 168 to blade-cartridge/pusher set 164.

As noted above, FIG. 16 illustrate a similar assembly 1608 in the context of a Julienning/dicing blade-cartridge/pusher set 1600 in which retainer 1604 securely holds pusher 1600B in engagement with blade cartridge 1600A such that the backing 1700 (FIG. 17) of the pusher covers the sharp edges 1800 (FIG. 18) of the blades 1804 to protect a user from injury. Bosses 1704A and 1704B are the same in purpose and function as bosses 1208A and 1208B of FIG. 12 as shown on blade cartridge 1600A in FIGS. 17 and 18. Likewise, "front" portion 1708 (FIG. 17) is designed and configured to springingly snap-fit with and catch on bosses 1704A and 1704B in the manner described above in section 5 relative to retainer 168. FIG. 17 also illustrates how the "back" portion 1712 is configured with a flange 1716 to hook around the backside 1720 of blade cartridge 1600A. It is noted that retainer 1604 may be identical to retainer 168 so that only one universal configuration is needed. This simplifies manufacturing, stocking, etc.

Each of retainers 168 and 1604 described in this section can be provided with a liberal amount and/or extent of openings, such as corresponding respective openings 1420 (FIG. 14) and openings 1612 (FIG. 16) to allow wash-water and or wash-solution to freely circulate through corresponding respective assemblies 1400 and 1608.

6) Blade-Cartridge Lock

Figure 21:
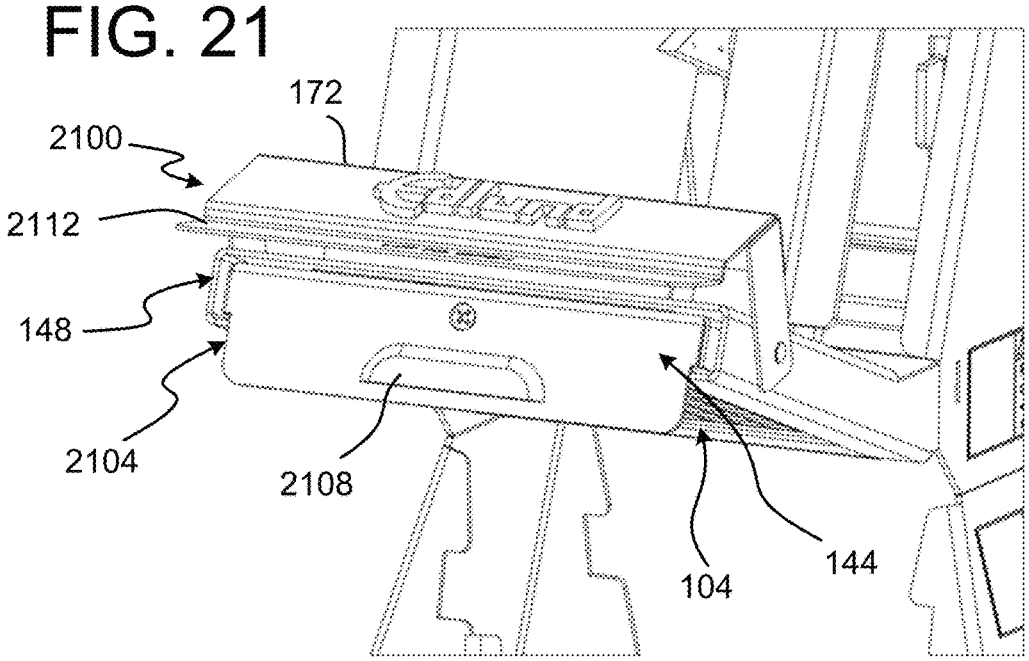
FIG. 21 is perspective partial view of the food product-pusher apparatus of FIG. 1, showing the tool-less blade-cartridge lock in an open position.
Figure 22:
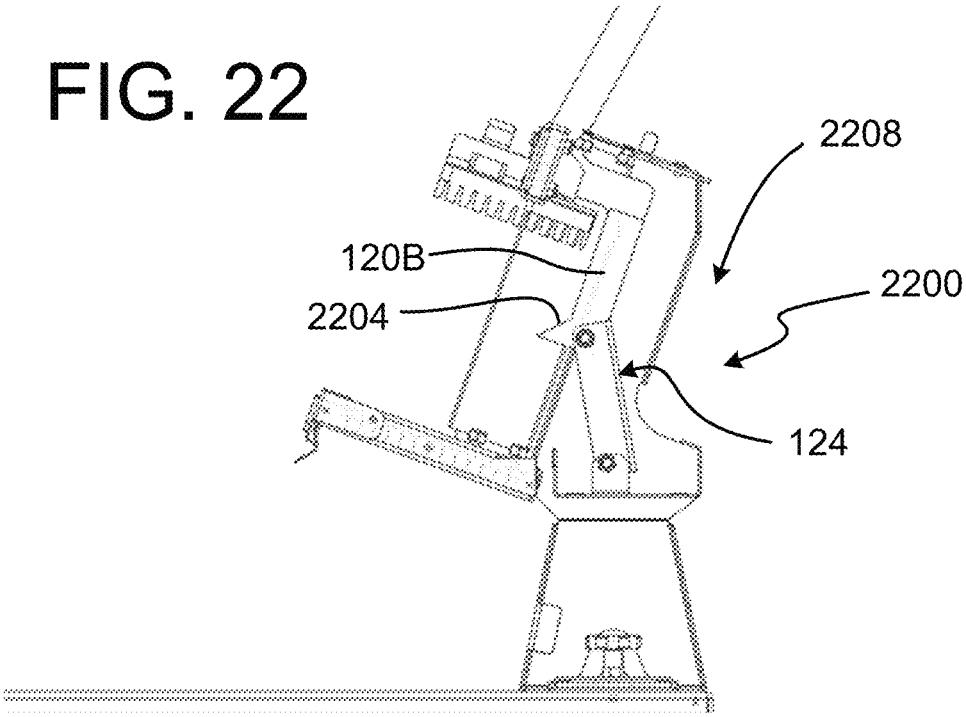
FIG. 22 is a side-elevational partial view of an alternative cutting apparatus of the present invention that includes a retractable food product stabilizer, showing a portion of the product guide removed for clarity.

As seen in numerous figures, such as FIGS. 1, 3-7, 9, 10, and 21, cutting apparatus 100 includes a blade-cartridge lock 172 that is pivotably secured to blade-cartridge receiver 148. In all but FIG. 21, blade-cartridge lock 172 is shown in its locked position such that it retains blade cartridge 144 securely in blade-cartridge receiver 148 during cutting operation. In FIG. 21, however, blade-cartridge lock 172 is shown in its unlocked position 2100, pivoted upward and backward to reveal front 2104 of blade cartridge 144. When blade-cartridge lock 172 is in unlocked position 2100, a user can remove and reinstall blade cartridge 144 or install another blade cartridge, such as either blade cartridge 164B or 1600A described above. In addition, when blade-cartridge lock 172 is in unlocked position 2100, the blade-cartridge lock partially blocks a user from placing food product onto blade cartridge 144 and blocks a user from moving pusher 108 through blade set 104 to complete a cutting operation. Rather, the user must move blade-cartridge lock 172 into its closed position (FIGS. 1, 3-7, 9, and 10) before a cutting operation. This ensures that blade cartridge 144 is secure during any cutting operation.

As seen in FIG. 21, blade cartridge 144 includes a boss 2108 on its front 2104. This boss is identical in function to bosses 1208A and 1208B of FIG. 12 and bosses 1704A and 1704B of FIG. 17. In addition to boss 2108 providing the same function as bosses 1208A and 1208B and bosses 1704A and 1704B described above, it also provides a similar snap-fit catching function for blade-cartridge lock 172. As seen in FIG. 21, blade-cartridge lock 172 is designed and configured to include a catch 2112 that catches on boss 2108 when the blade-cartridge lock is pivoted from the open position 2100 of FIG. 21 to the closed position illustrated in FIGS. 1, 3-7, 9, and 10. This provides cutting apparatus 100 with a convenient tool-less and fastener-less arrangement for securing locking blade cartridge 144 into place.

7) Quick-Connect Pusher

Figure 19:
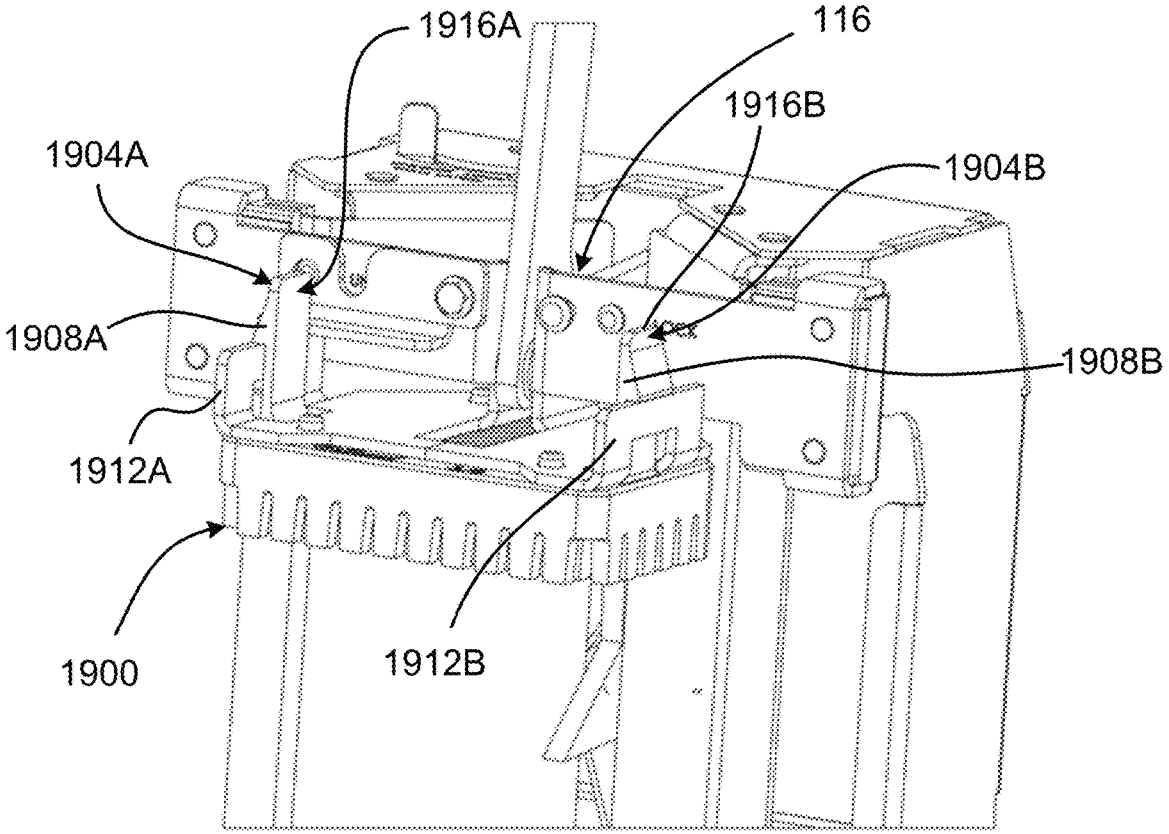
FIG. 19 is a perspective partial view of the food product-pusher apparatus of FIG. 1, showing the quick-connect pusher receiver of the food product cutting apparatus, showing the receiver in its resting-open position and engaged by a wedging pusher.
Figure 20:
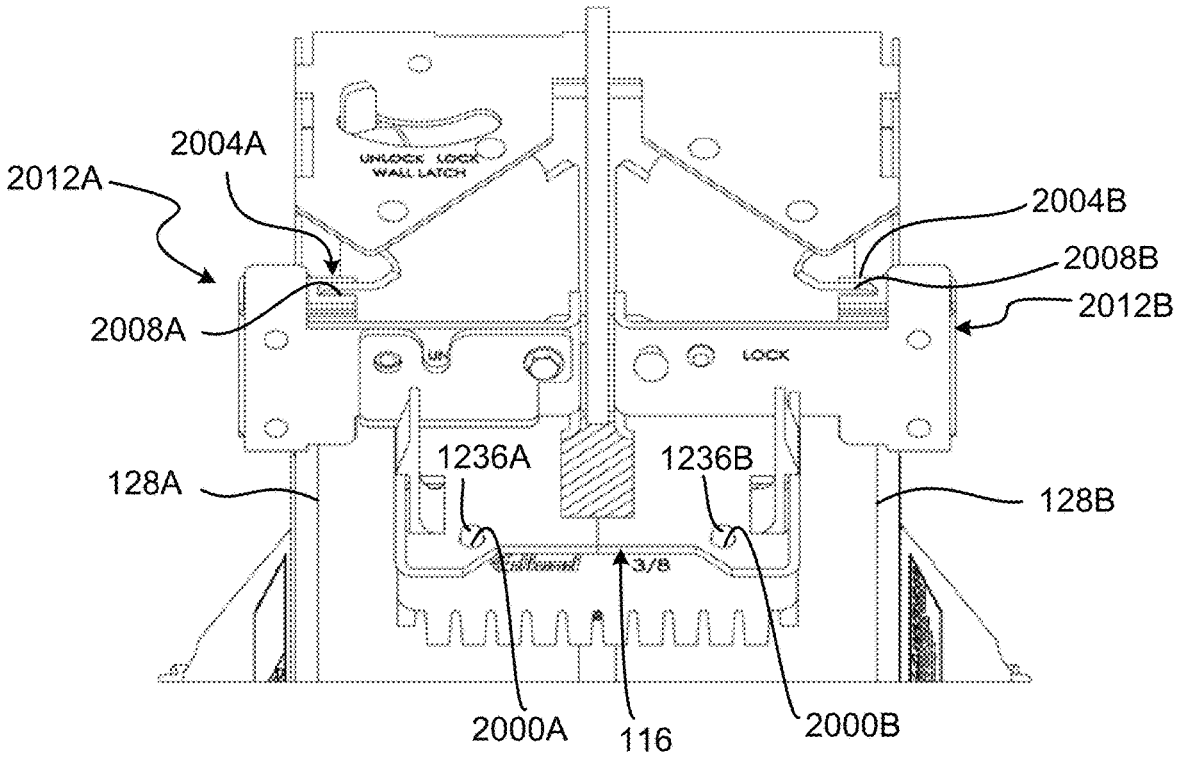
FIG. 20 is a perspective view of the upper end of the food product cutting apparatus of FIG. 1, showing the sliding engagement of the pusher assembly with the pair of support slides.

As seen in many of the accompanying figures, but especially in FIG. 19, each pusher, here, pusher 1900 used with cutting apparatus 100 is provided with a pair of locking members 1904A and 1904B that include corresponding respective catches 1908A and 1908B that springingly catch on corresponding respective pusher supports 1912A and 1912B of pusher assembly 116. In the configuration shown in FIG. 19, to remove pusher 1900 from pusher assembly 116, a user pinches toward one another upper ends 1916A and 1916B of locking members 1904A and 1904B to move catches 1908A and 1908B out of engagement with pusher supports 1912A and 1912B and then lower the pusher relative to the pusher assembly. As those skilled in the art can readily envision, to install pusher 1900 after being removed, a user moves the pusher into position below pusher assembly 116 and aligns locking members 1904A and 1904B with pusher supports 1912A and 1912B, respectively, and then pushes upward on the pusher so that the locking members elastically bend slightly toward one another until catches 1908A and 1908B snap-fittingly engage the pusher supports. In the embodiment shown in FIG. 19, locking members 1904A and 1904B are metal tabs overmolded into pusher 1900. In other embodiments, such as pusher 164A of FIGS. 12 and 13, locking members 1224A and 1224B are made of plastic and are molded integrally with backing 1300 of the pusher, as are fingers 1232 of the pusher. As also seen in FIGS. 12 and 13, backing 1300 also includes alignment features 1236A to 1236D that help to ensure the alignment of pusher 164A with corresponding blade cartridge 164B during cutting operations. Alignment features engage corresponding respective openings on pusher assembly 116, such as seen in FIG. 20 with two of the alignment features 1236A and 1236B shown engaging openings 2000A and 2000B, respectively.

8) Anti-Binding Pusher-Assembly Guide Mechanism

As described above, cutting apparatus 100 includes a pair of slide rails 128A and 128B, which in this embodiment are integrated monolithically with V-shaped product guide 132. Referring to FIG. 20, slide rails 128A and 128B are slidingly engaged, respectively, by a pair of slides 2004A and 2004B, which are secured to pusher assembly 116 and are made of polytetrafluoroethylene (PTFE) to provide excellent sliding ability. Each slide 2004A and 2004B in this example is an elongated block of PTFE having a central channel 2008A and 2008B that snugly receives a corresponding one of slide rails 128A and 128B. The flat configuration of slide rails 128A and 128B, the "self-lubricating" design of slides 2004A and 2004B, and the tight fit of channels 2008A and 2008B with the slide rails make the corresponding guide mechanisms 2012A and 2012B resistant to binding. As those skilled in the art will appreciate, conventional designs having circular rods as guides are prone to binding, especially when the interaction of the pusher with a food product causes eccentric forces on the pusher relative to the slide axes of the guide rods. This binding problem is solved using guide mechanisms the same as or similar to guide mechanisms 2012A and 2012B.

9) Monolithic Pusher Having Wash-Enhancing Features

FIGS. 12, 13 and 17 illustrate, two monolithic pushers 164A and 1600B made of a suitable material, such as plastic, among others. In both of pushers 164A and 1600B, their backings 1300 and 1700, respectively, are integrally formed with their fingers 1232 in the case of pusher 164A, but the fingers are not seen in FIG. 17 for pusher 1600B, though similar fingers 900 are seen in FIG. 9. As seen in FIG. 12, backing 1300 of pusher 164A includes a plurality of arcuate slotted openings 1240 that allow wash-water and/or wash-solution to pass through the backing and into the spaces formed among fingers 1232 to enhance washability of the pusher. Similarly, as seen in FIG. 17, backing 1700 of pusher 1600B includes diagonal slotted openings 1724 that intersect with the grid-like pattern of channels formed by the rectangular fingers on the opposite side of backing 1700. The diagonal arrangement of openings 1724 provide pusher 1600B with structural stability, since the diagonal-slotted openings are arranged so that for slots crossing near the diagonal center of an underlying finger, that finger is supported by the remaining portions of backing 1700 on either side of that slot. This provides pusher 1600B with a very rigid structure. The unique six-sided shape of each pusher 164A and 1600B is a result of making the pusher shape conform to the V-shape of product guide 132. As described above, FIGS. 29-32 illustrate an easy-clean Julienning/dicing pusher similar to pusher 1600B, and FIGS. 32 to 34 illustrate an exemplary alternative easy-clean configuration of the backing.

10) Blade Cartridge Having Simplified Blade-Tensioning Arrangement

Figure 11:
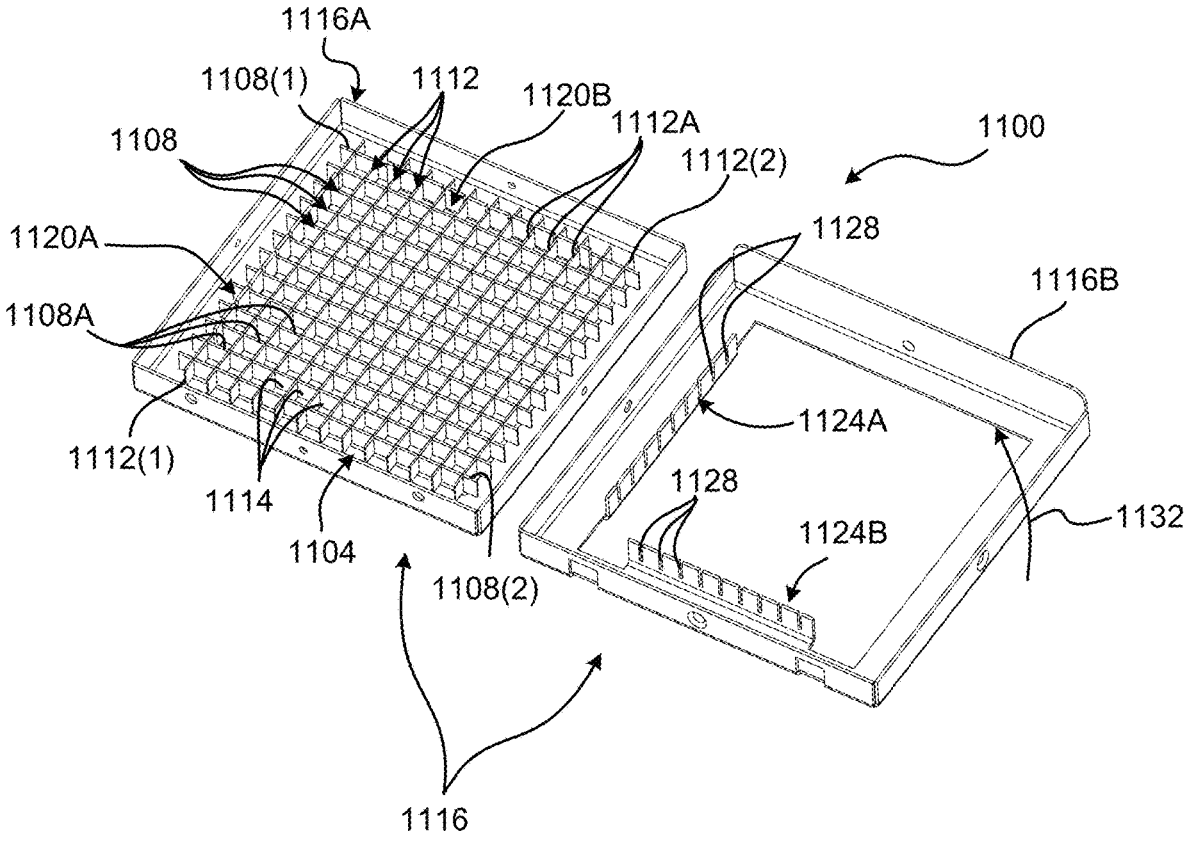
FIG. 11 is an isometric view of the Julienning/dicing blade cartridge of the food product cutting apparatus of FIG. 1, showing the blade cartridge partially disassembled.

Referring now to FIG. 11, this figure illustrates an exemplary construction 1100 of a Julienning/dicing blade cartridge. In this example, construction 1100 includes a blade grid 1104 comprising crisscrossing perpendicular blades 1108 (one direction) and 1112 (the other direction) in which all of the blades have the same depth as one another. This crisscross pattern of blade grid 1104 provides a plurality of food openings 1114 through which the food product (not shown) passes as the corresponding pusher, such as food pusher 108 of FIG. 1, pushes the food product into and through the blade grid. Where crisscrossing occurs, each of the corresponding respective blades 1108 and 1112 is notched to half of its depth to receive the un-notched portion of the other blade. In this manner, each of blades 1108 and 1112 is continuous across the length/width of blade grid 1104 and the cutting edges 1108A and 1112A of the blades all lie in a common plane. Construction 1100 also includes a two-part frame 1116 that comprises an inner part 1116A and an outer part 1116B, each having a pair of slotted grid retainers 1120A and 1120B and 1124A and 1124B, respectively on two adjacent sides. Each slotted grid retainer 1120A, 1120B, 1124A, and 1124B has a plurality of slots 1128 for receive a corresponding one of blades 1108 or 1112 so that the corresponding grid retainer can be located inboard of the first blade 1108(1), 1108(2), 1112(1), and 1112(2) along the corresponding respective ends of blade grid 1104. As a skilled artisan can readily envision, when blade grid 1104 is placed between inner and outer frame parts 1116A and 1116B with slotted grid retainers 1120A, 1120B, 1124A, and 1124B properly engaged with the corresponding respective end blades 1112(1), 1108(1), 1112(2), and 1108(2) by pivoting the outer frame part as shown by arrow 1132, the two frame parts can be biased against one another in the plane of the grid, such as with screws, in a manner that tensions blades 1108 and 1112 in both directions of blade grid 1104. Such a two-part frame 1116 and grid construction greatly simplifies creating a Julienning/dicing blade cartridge.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A food product cutting apparatus for cutting a food product, comprising:

a chassis designed and configured to engage a supporting structure so that the food product cutting apparatus is stable during a cutting operation;

a blade set fixed relative to said chassis, said blade set having:

a plurality of blades spaced to define a plurality of food openings for receiving cut portions of the food product therethrough during the cutting operation of the food product cutting apparatus; and a cutting edge side;

a pusher head designed and configured to push the food product through said blade set, said pusher head movable relative to said blade set toward and away from said blade set on said cutting edge side;

a guide mechanism defining a cutting thrust axis for said pusher head, said guide mechanism designed and configured to guide said pusher head along said cutting thrust axis during the cutting operation, wherein said cutting thrust axis forms an angle of 0° to 30° relative to vertical when said chassis is supported by the supporting structure; and a handle mechanism coupled to said chassis and engaged with said pusher head, said handle mechanism designed and configured to:

provide said handle mechanism with a self-stable food loading position in which said handle mechanism holds the pusher head spaced from said blade set by action of gravity working on said handle mechanism; and allow a user to manually drive said pusher head from said self-stable food loading position along said cutting thrust axis toward said blade set with said guide mechanism guiding said pusher head along said cutting thrust axis;

said handle mechanism including:

a pusher arm having a handle and a fulcrum pivot located distally from said handle, wherein said pusher head is rotatably secured to said pusher arm between said handle and said fulcrum pivot; and a linkage mechanism comprising a pivoting link extending from said fulcrum pivot to a chassis pivot fixedly located on said chassis at a location below said fulcrum pivot when said chassis is engaged with the supporting structure, said pivoting link being pivotable about said chassis pivot, and said pusher arm being pivotable about said fulcrum pivot;

wherein, when said handle mechanism is in said self-stable food loading position, said pusher head is in a fixed orientation relative to said blade set, and said pusher head maintains said fixed orientation when said pusher head is moved toward and away from said blade set by user-actuation of said handle mechanism.

2. A food product cutting apparatus according to claim 1, wherein said handle mechanism is designed and configured to allow the user to manually drive said pusher head from said self-stable food loading position by the user applying a force to said handle that moves said pusher head along said cutting thrust axis in a direction toward said blade set.

3. A food product cutting apparatus according to claim 1, wherein said handle mechanism is designed and configured to allow the user to put said pusher head in said self-stable food loading position by the user applying only a pusher head retraction force to said handle.

4. A food product cutting apparatus according to claim 1, wherein said fulcrum pivot has a fulcrum pivot axis and said chassis pivot has a chassis pivot axis and when the user manually drives said pusher head from said self-stable food loading position toward said blade set said fulcrum pivot moves so that a line perpendicular to and connecting together said fulcrum pivot axis and said chassis pivot axis along said link moves from a negative angle relative to vertical to a positive angle relative to vertical.

5. A food product cutting apparatus according to claim 4, wherein said handle mechanism includes a stop that limits said negative angle.

6. A food product cutting apparatus according to claim 5, wherein said stop is present on said link and engages a part of said pusher arm to hold said pusher head in said self-stable food loading position when said line is at the negative angle relative to vertical.

7. A food product cutting apparatus according to claim 1, further comprising a retractable food stabilizer designed and configured to retractably disengage the food product as the user manually drives said pusher head from said self-stable food loading position toward said blade set using said handle mechanism.

8. A food product cutting apparatus according to claim 7, wherein said retractable food stabilizer includes a food engaging structure secured to said pusher arm proximate to said fulcrum pivot.

9. A food product cutting apparatus according to claim 8, wherein said food engaging structure comprises a food-piercing member.

10. A food product cutting apparatus according to claim 1, wherein when said handle mechanism is in said self-stable food loading position said pusher head is maximally spaced from said blade set.

11. A food product cutting apparatus according to claim 1, wherein:

said guide mechanism includes:

a food product guide fixed relative to said chassis, said food product guide having guide walls extending away from said blade set on said cutting edge side, said guide walls being parallel to said cutting thrust axis and defining a concave food product receiving region relative to said food product loading side; and first and second slide rails attached to corresponding respective ones of said guide walls and each having longitudinal axes extending parallel to said cutting thrust axis;

the food product cutting apparatus further comprises a pusher assembly movable relative to said chassis and having first and second slides slidably engaging corresponding respective ones of said first and second slide rails, wherein said pusher assembly includes said pusher head; and said handle mechanism designed and configured to allow a user to manually drive said pusher assembly along said cutting thrust axis toward said blade set with said first and second slides sliding correspondingly respectively along said first and second slide rails so as to guide said pusher assembly along said cutting thrust axis.

12. A food product cutting apparatus according to claim 11, wherein said guide walls are configured to form a V shape in a cross-section perpendicular to said cutting thrust axis.

13. A food product cutting apparatus according to claim 11, wherein said pusher head has a shape conforming to said guide walls.

14. A food product cutting apparatus according to claim 11, wherein said pair of slide rails are lateral extensions of said food product guide walls.

15. A food product cutting apparatus according to claim 1, wherein the food product cutting apparatus is designed and configured to be secured to a universal mount having universal mounting features and being configured to be secured, alternatively, to each of a vertical surface and a horizontal surface of the supporting structure and said chassis includes:

a lower end when said chassis is oriented for the cutting operation;

a backside when said chassis is oriented for the cutting operation;

a set of horizontal-mounting features located on said lower end of said chassis, said set of horizontal-mounting features designed and configured to interlock with the universal mounting features on the universal mount so as to secure the food product cutting apparatus to the horizontal mount so that, when the universal mount is secured to the horizontal surface, said cutting thrust axis has an operating orientation; and a set of vertical-mounting features located on said backside of said chassis, said set of vertical-mounting features designed and configured to interlock with the universal mounting features on the universal mount so as to secure the food product cutting apparatus to the vertical mount so that, when the universal mount is secured to the vertical surface, said cutting thrust axis has the same operating orientation as when said set of horizontal mounting features and the horizontal mount are used.

16. A food product cutting apparatus according to claim 15, further comprising the universal mount.

17. A food product cutting apparatus according to claim 16, further comprising a movable platform base that includes the common mounting features and extends underneath said blade set when said horizontal-mounting features are engaged with the common mounting features so that the food product cutting apparatus is secured to said movable platform.

18. A food product cutting apparatus according to claim 15, further comprising a movable platform base that includes the common mounting features and extends underneath said blade set when said horizontal-mounting features are engaged with the common mounting features so that the food product cutting apparatus is secured to said movable platform.

19. A food product cutting apparatus for cutting a food product, comprising:

a chassis designed and configured to engage a supporting structure so that the food product cutting apparatus is stable during a cutting operation;

a blade set fixed relative to said chassis, said blade set having:

a plurality of blades spaced to define a plurality of food openings for receiving cut portions of the food product therethrough during the cutting operation of the food product cutting apparatus; and a cutting edge side;

a pusher head designed and configured to push the food product through said blade set, said pusher head movable relative to said blade set toward and away from said blade set on said cutting edge side;

a guide mechanism defining a cutting thrust axis for said pusher head, said guide mechanism designed and configured to guide said pusher head along said cutting thrust axis during the cutting operation, wherein said cutting thrust axis forms an angle of 0° to 30° relative to vertical when said chassis is supported by the supporting structure; and a handle mechanism coupled to said chassis and engaged with said pusher head, said handle mechanism designed and configured to:

provide said handle mechanism with a self-stable food loading position in which said handle mechanism holds the pusher head spaced from said blade set by action of gravity working on said handle mechanism; and allow a user to manually drive said pusher head from said self-stable food loading position along said cutting thrust axis toward said blade set with said guide mechanism guiding said pusher head along said cutting thrust axis; and said handle mechanism including a pusher arm having a handle and a fulcrum pivot located distally from said handle, wherein said pusher had is rotatably secured to said pusher arm between said handle and said fulcrum pivot;

wherein:

when said handle mechanism is in said self-stable food loading position, said pusher head is in a fixed orientation relative to said blade set; and said pusher head maintains said fixed orientation when said pusher head is moved toward and away from said blade set by user-actuation of said handle mechanism.

* * * * *